US006933092B2

(12) United States Patent
Yoshida et al.

(10) Patent No.: US 6,933,092 B2
(45) Date of Patent: Aug. 23, 2005

(54) MAGENTA TONER FOR ELECTROPHOTOGRAPHY AND FULL COLOR IMAGE FORMATION METHOD

(75) Inventors: Satoshi Yoshida, Minamiashigara (JP); Yasuo Matsumura, Minamiashigara (JP); Toyofumi Inoue, Minamiashigara (JP); Hidekazu Yaguchi, Minamiashigara (JP); Takahisa Fujii, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/219,657

(22) Filed: Aug. 16, 2002

(65) Prior Publication Data

US 2003/0194628 A1 Oct. 16, 2003

(30) Foreign Application Priority Data

Jan. 24, 2002 (JP) ..... 2002-015731

(51) Int. Cl.[7] ..... G03G 9/09

(52) U.S. Cl. ..... 430/108.23; 430/125; 430/126; 430/137.14

(58) Field of Search ..... 430/137.14, 125, 430/124, 108.23, 110.3, 110.4, 108.1

(56) References Cited

U.S. PATENT DOCUMENTS 5,262,264 A * 11/1993 Shimizu et al. ..... 430/107.1

(Continued)

FOREIGN PATENT DOCUMENTS

EP 0 869 398 A2 10/1998

(Continued)

*Primary Examiner*—Christopher RoDee
(74) *Attorney, Agent, or Firm*—Oliff & Berridge, PLC

(57) ABSTRACT

A magenta toner for electrophotography includes a binder resin and a colorant, wherein the toner contains at least a naphthol pigment having a structure represented by the following general formula (1) as the colorant, and has a shape factor SF1 of 110 to 140 obtained by the equation below and a volume average particle size of 2 to 9 μm:

General formula (1)

wherein R represents the following group, and R' represents a hydrogen atom, an alkyl group or a methoxy group;

$$SF1=R^2/A\times\pi/4\times100$$

wherein R represents the maximum length of the toner and A represents the projected area of the toner.

17 Claims, 3 Drawing Sheets

U.S. PATENT DOCUMENTS

| | | | | | |
|---|---|---|---|---|---|
| 6,117,605 | A | * | 9/2000 | Chiba | 430/108.21 |
| 6,667,140 | B2 | * | 12/2003 | Tosaka et al. | 430/108.23 |
| 2002/0037466 | A1 | * | 3/2002 | Kanbayashi et al. | 430/108.23 |
| 2002/0172880 | A1 | * | 11/2002 | Takayanagi et al. | 430/108.23 |

FOREIGN PATENT DOCUMENTS

| | | |
|---|---|---|
| EP | 1 109 069 A2 | 6/2001 |
| EP | 1 237 047 A1 | 9/2002 |

* cited by examiner

MAGENTA TONER FOR ELECTROPHOTOGRAPHY AND FULL COLOR IMAGE FORMATION METHOD

BACKGROUND OF THE INVENTION

1. Field of the Invention

The present invention relates to a magenta toner for electrophotography (hereinafter, sometimes referred to simply as toner) used in machines utilizing an electrophotographic process such as copying machines, printers, facsimiles and the like, particularly, in color copying machines, and a full color image forming method using the same.

2. Description of the Related Art

As the electrophotographic process, a lot of processes including methods described in Japanese Patent No. 42-23910 and the like are conventionally known. In the electrophotographic process, a fixed image is formed via a plurality of steps in which a latent image is formed electrically by various means on a photoreceptor including a photoconductive substance, this latent image is developed using a toner, the toner image on the photoreceptor is transferred onto a recording film such as paper and the like directly or via an intermediate transfer body, and then this transferred image is fixed by heat, press, heat and press, or solvent vapor and the like. Toners remaining on the photoreceptor are removed if necessary by various methods, and the above-mentioned plurality of steps are repeated. Recently, with progress of technologies in the field of electrophotography, such an electrophotographic process is used not only in copying machines and printers but also in printing application, and there are increasingly strict requirements for high image quality and hue of copies equivalent to those of prints, in addition to high speed and high reliability of apparatuses.

In order to attain such requirements, there are various investigations and various suggestions in many aspects such as the melting property of a binder resin, the kind of a colorant, the particle size distribution of a toner, additives and the like. Japanese Patent Application Laid-Open (JP-A) No. 5-142867 suggests a technology in which hue and high reliability are satisfied simultaneously by using a specific pigment. JP-A No. 2000-199982 suggests a technology in which wider hue is reproduced by using a specific toner. JP-A No. 2000-131887 suggests a technology in which high image quality and high reliability are realized by using a toner having specific shape factor SF1 and particle size distribution, and having specific hue. JP-A No. 2001-166541 suggests a technology in which high image quality and high reliability are realized by combining a specific binder resin and a specific colorant.

These technologies can surely reproduce image quality near that by printing, however, this is realized by coated paper having smooth surface and color dedicated paper having enhanced smoothness on the surface for color photography, and in the case of paper having poor surface smoothness such as recycled paper and the like, hue changes and color range narrows in some cases. In particular, when cyan, magenta and yellow toners are used, hue changes easily and color range easily narrows in secondary colors such as red and blue. Recently, regard for environment is strictly required, and use of recycled paper is supposed to further increase, and it is necessary that high image quality is not deteriorated even if paper having poor surface smoothness is used.

On the other hand, JP-A Nos. 11-272014, 2001-249497 and 2001-249497 suggest technologies in which high image quality and high reliability are realized by toners using specific colorants (pigments). However, also in these technologies, since a toner is produced at about 60° C. in a kneading grinding method or wet production, the form of a toner is irregular, and as well as the above-mentioned cases, high image quality and high reliability are realized by coated paper having smooth surface and color dedicated paper having enhanced smoothness on the surface for color photography, and in the case of paper having poor surface smoothness such as recycled paper and the like, hue changes and color range narrows in some cases.

SUMMARY OF THE INVENTION

The present invention is intended to solve the above-mentioned conventional problems and to attain the following object. Namely, the object of the invention is to provide a magenta toner for electrophotography which can form an image of high quality even if paper (a recording medium) having an uneven surface is used, and a full color image forming method using the same.

The present inventors have investigated a mechanism of deterioration in image quality when paper having an uneven surface is used, in consideration of behaviors in a fixing process, and resultantly found that generation of the above-mentioned problem can be suppressed when a toner contains a specific colorant and, has specific form and specific volume average particle size, and have completed the invention. Namely, a first aspect of the invention provides a magenta toner for electrophotography comprising a binder resin and a colorant, wherein the toner contains at least a naphthol pigment having a structure represented by the following general formula (1) as the colorant, and has a shape factor SF1 of 110 to 140 obtained by the equation below and a volume average particle size of 2 to 9 $\mu$m:

General formula (1)

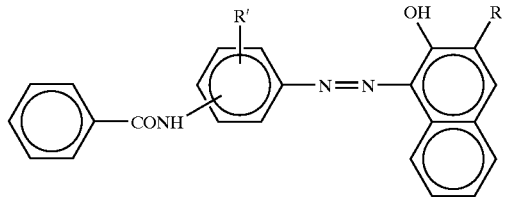

wherein R represents the following group,

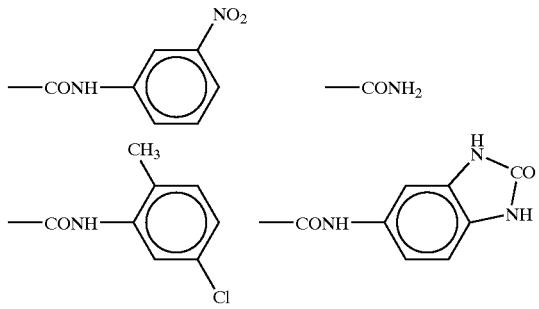

-continued

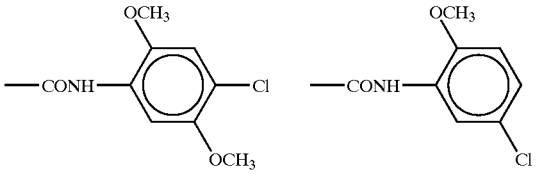

and R' represents a hydrogen atom, an alkyl group or a methoxy group;

$$SF1=R^2/A\times\pi/4\times100$$

wherein R represents the maximum length of the toner and A represents the projected area of the toner.

A second aspect of the invention provides a developer comprising a magenta toner for electrophotography and a carrier, the magenta toner including at least a naphthol pigment having a structure represented by the following general formula (1) as a colorant and a binder resin, and having a shape factor SF1 of 110 to 140 obtained by the equation below and a volume average particle size of 2 to 9 μm:

General formula (1)

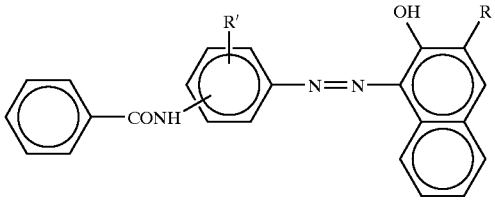

wherein R represents the following group,

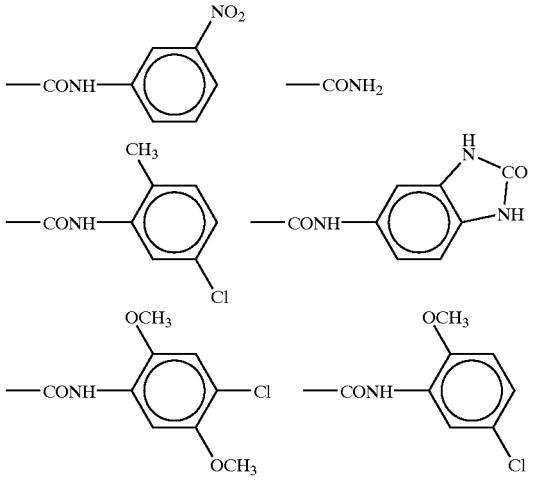

and R' represents a hydrogen atom, an alkyl group or a methoxy group;

$$SF1=R^2/A\times\pi/4\times100$$

wherein R represents the maximum length of the toner and A represents the projected area of the toner.

A second aspect of the invention provides a developer comprising a magenta toner for electrophotography and a carrier, the magenta toner including at least a naphthol pigment having a structure represented by the following general formula (1) as a colorant and a binder resin, and having a shape factor SF1 of 110 to 140 obtained by the equation below and a volume average particle size of 2 to 9 μm:

General formula (1)

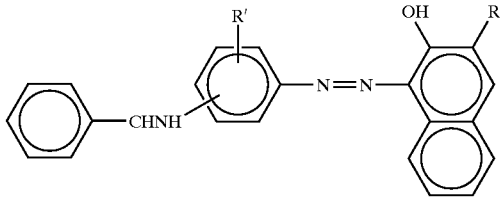

wherein R represents the following group,

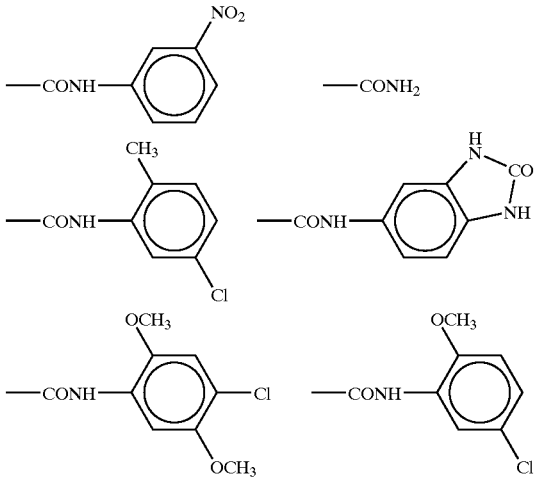

and R' represents a hydrogen atom, an alkyl group or a methoxy group;

$$SF1=R^2/A\times\pi/4\times100$$

wherein R represents the maximum length of the toner and A represents the projected area of the toner.

A third aspect of the invention provides a method of producing a magenta toner for electrophotography comprising the steps of: forming aggregated particles containing binder resin particles in a dispersion containing the binder resin particles, to prepare an aggregated particle dispersion; and coalescing the aggregated particles, wherein the produced toner contains a binder resin and, as a colorant, at least a naphthol pigment having a structure represented by the general formula (1), and has a shape factor SF1 of 110 to 140 obtained by the equation below and a volume average particle size of 2 to 9 μm.

General formula (1)

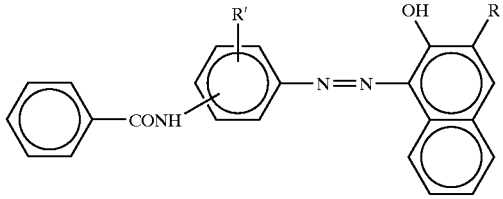

wherein R represents the following group,

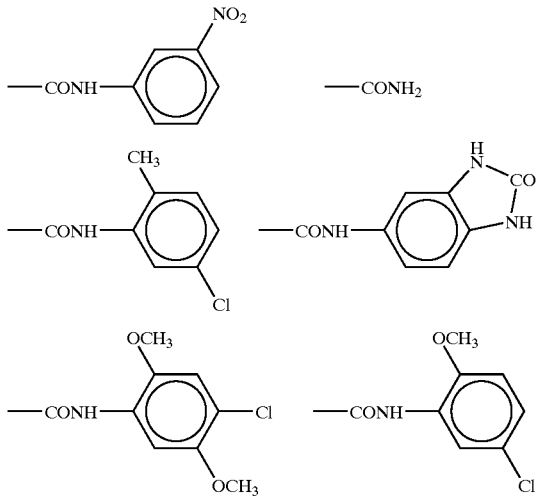

and R' represents a hydrogen atom, an alkyl group or a methoxy group;

$$SF1=R^2/A\times\pi/4\times100$$

wherein R represents the maximum length of the toner and A represents the projected area of the toner.

A fourth aspect of the invention provides a method of forming a full color image comprising the steps of: forming an electrostatic latent image on a photoreceptor; developing the electrostatic latent image using a developer containing a toner, to form a toner image; transferring the toner image onto a recording medium; and thermally fixing the toner image on the recording medium, wherein the toner is a magenta toner for electrophotography including at least a naphthol pigment having a structure represented by the following general formula (1) as the colorant and a binder resin, and having a shape factor SF1 of 110 to 140 obtained by the equation below and a volume average particle size of 2 to 9 $\mu$m.

General formula (1)

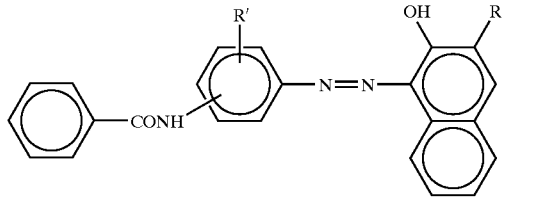

wherein R represents the following group,

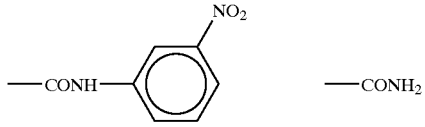

-continued

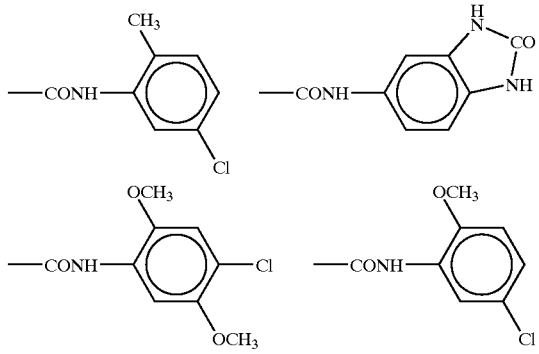

and R' represents a hydrogen atom, an alkyl group or a methoxy group;

$$SF1=R^2/A\times\pi/4\times100$$

wherein R represents the maximum length of the toner and A represents the projected area of the toner.

DESCRIPTION OF THE PREFERRED EMBODIMENT

Figure 1:
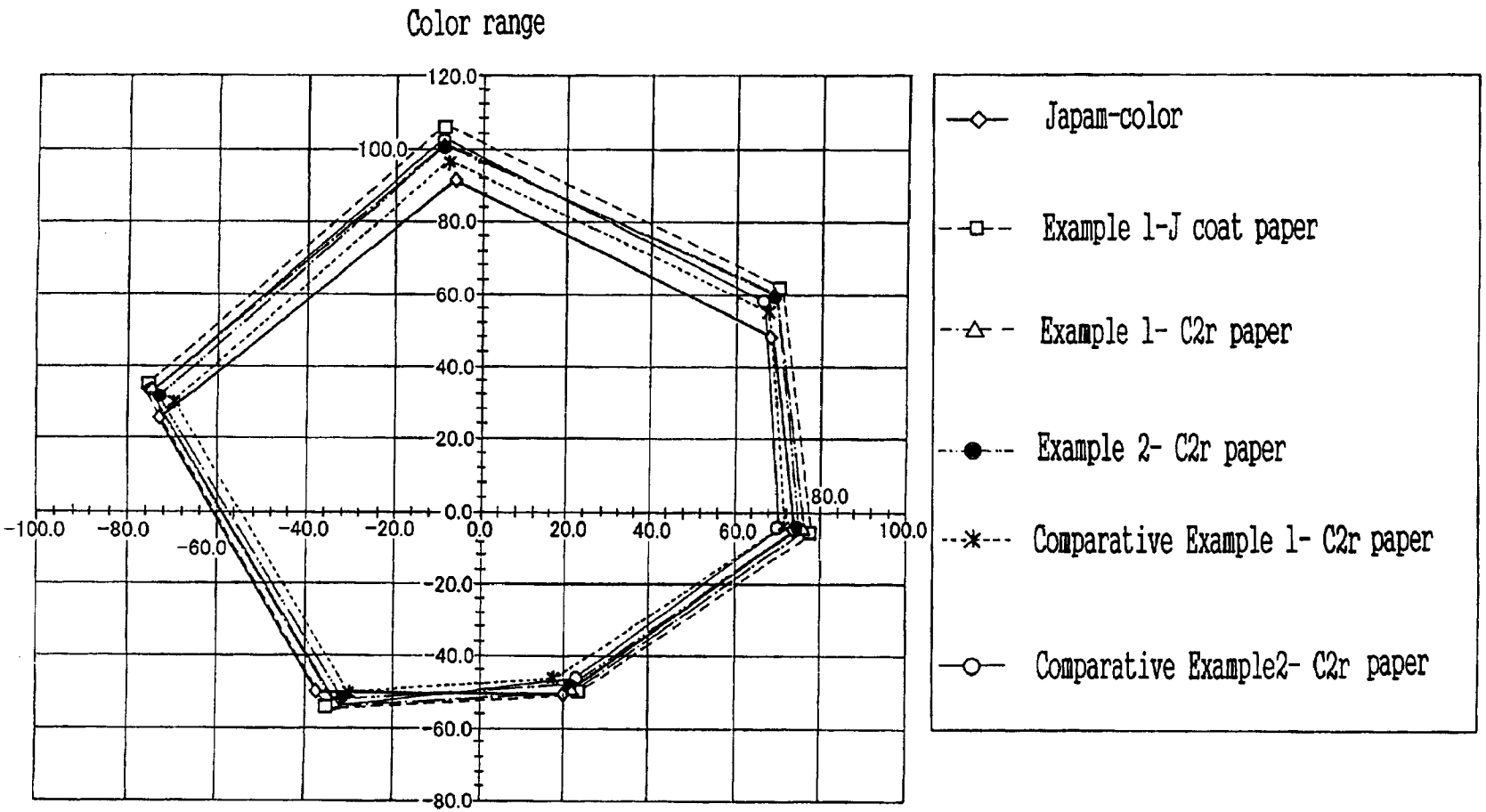
FIG. 1 is a view showing the results of color range evaluation 1 in examples.

The present invention will be illustrated in detail below.

The magenta toner for electrophotography of the invention comprises a binder resin and a colorant, wherein at least a naphthol pigment having a structure represented by the following general formula (1) is contained as the above-mentioned colorant, and the toner has a shape factor SF1 of 110 to 140 and a volume average particle size of 2 to 9 $\mu$m:

General formula (1)

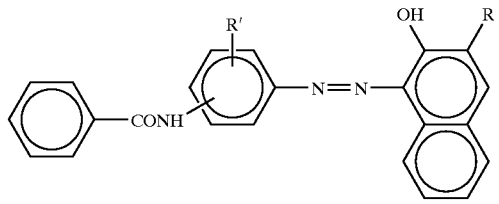

wherein, R represents the following group,

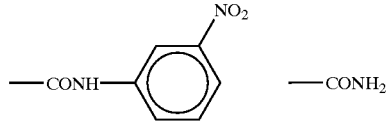

-continued

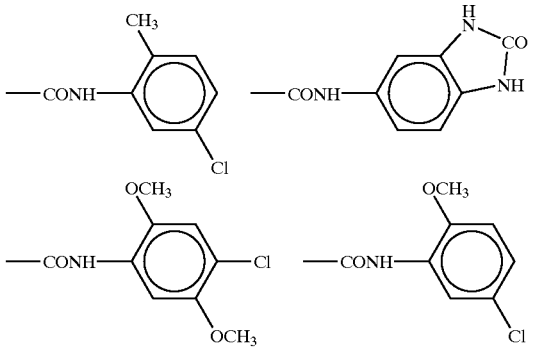

and R' represents a hydrogen atom, alkyl group or methoxy group:

$$SF1=R^2/A\times\pi/4\times100$$

wherein, R represents the maximum length of the toner, and A represents the projected area of the toner.

The magenta toner for electrophotography of the invention can suppress change of hue and enlarge color range, and can form an image of high quality even if paper (a recording medium) having an uneven surface is used.

In general, causes of deterioration in image quality on a recording medium having an uneven surface such as recycled paper and the like are believed to reside in a transfer process and fixing process. Specifically, transfer is usually conducted by utilizing electric field in a transfer process. However, since effective electric field applied to a toner changes by unevenness of a recording medium, transfer is partially impossible, spattering of the toner occurs, and the like, leading to deterioration in image quality. In the case of a recording medium having large unevenness on the surface, a toner in convex portions flows to concave portions by fixation pressure and heat in a fixing process. Further, the toner amount is originally small in concave portions due to transfer failure, and additionally, a toner permeates into paper due to capillary phenomenon (hereinafter, sometimes referred to as permeation phenomenon). In the case of secondary or higher-order color, the toner of a lower layer permeates more into paper than the toner of an upper layer in concave portions of the recording medium, and therefore, if the coloring force of the toner of the upper layer is strong, hue also changes. This phenomenon is believed to be the cause.

In view of such facts, the present inventors have intensively studied and resultantly found as methods of preventing the above-mentioned image quality deterioration (1) improving uniformity of transfer, (2) controlling the coloring force of toners laminated to form secondary or higher-order colors, and (3) preventing the permeation phenomenon. Based on these methodes, uniformity of transfer can be improved by controlling the shape factor SF1 of toners within the range from 110 to 140 and the volume average particle size within the range from 2 to 9 $\mu$m, and additionally, heat conduction between toners at the time of fixing becomes excellent by increase in density of anunfixed toner image due to improvement in toner flowability, resultantly, the permeation phenomenon is suppressed, and further, inhibition of the color of the lower layer can be suppressed by using a naphthol pigment having a structure represented by the general formula (1) as the colorant. Therefore, due to the above-mentioned structure, the magenta toner for electrophotography of the invention can form an image of high quality even if paper (a recording medium) having an uneven surface is used.

At least one naphthol pigment having a structure represented by the general formula (1) is used as the colorant (in the general formula (1), R' represents preferably a methoxy group (—$OCH_3$)), and examples of the naphthol pigment in which R' is a methoxy group include Pigment Red 31, 146, 147, 150, 176, 238, 269 and the like. Among them, particularly naphthol pigments having a structure represented by the general formula (2) are preferable from the standpoint of chargeability, and examples of such naphthol pigment include Pigment Red 238, 269 and the like.

Formula (2)

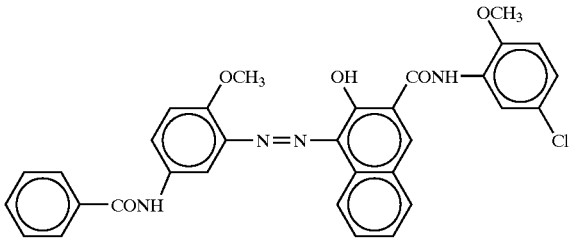

A combination of a naphthol pigment having a structure of the above-mentioned formula (1) and a quinacridone pigment as the colorants is preferable since color range is broaden and higher image quality can be obtained. As the quinacridone pigment, quinacridone pigments having a structure represented by the following general formula (3) are preferable, and examples thereof include Pigment Red 122, 202, 209 and the like. Among them, Pigment Red 122 is particularly preferable from the standpoints of productivity and chargeability:

General formula (3)

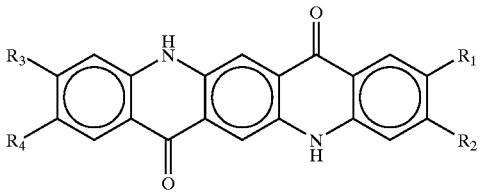

wherein, $R_1$, $R_2$, $R_3$ and $R_4$ represent H, $CH_3$ or Cl. $R_1$ is not the same as $R_2$ and $R_3$ is not the same as $R_4$.

It is preferable to use a combination of a naphthol pigment and a quinacridone pigment as the colorants in a content ratio thereof of 80:20 to 30:70 since higher image quality can be obtained, and the content ratio is more preferably 75:25 to 40:60, and particularly preferably 70:30 to 50:50. If the proportion of a naphthol pigment is too large, when the toner of the lower layer causes a permeation phenomenon, a desired hue may not be obtained because the toner of the upper layer hides the color of the toner of the lower layer to an extent that is too high. In contrast, when too small, coloring ability is deficient, and image density decreases.

As the colorant, for example, other colorants for controlling hue can be used together in an amount of 20% by mass or less based on the total amount of the colorant, in addition to the naphthol pigments and quinacridone pigments. Examples of the other colorants include various pigments such as Watch Young Red, Permanent Red, Brilliant Carmin 3B, Brilliant Carmin 6B, DuPont Oil Red, Pyrazolone Red, Lithol Red, Rhodamine B Lake, Lake Red C, Rose Bengal and the like, and azo colorants, xanthene colorants, and the like.

The toner of the invention is required to have a shape factor SF1 of 110 to 140, and the shape factor is preferably from 113 to 137, and more preferably from 115 to 135. When this shape factor SF1 is less than 110, adhesive force between toners becomes weak, and spattering of the toner tends to occur at the time of transfer. On the other hand, when SF1 exceeds 140, transferring property lowers and density of a toner image decreases in some cases.

The shape factor SF1 is represented by the formula: $SF1=(ML^2/A)\times(\pi/4)\times100$ (ML: the absolute maximum length of a toner particle, A: the projected area of the toner particle). SF1 is represented as numerical value by analyzing mainly a microscope image or scanning electron microscope (SEM) image using an image analysis apparatus, and for example, can be calculated as described below. Optical microscope images of toners scattered on a slide glass are incorporated into Ruzex image analysis apparatus via a video camera, and the maximum lengths and projected areas of 100 or more toner particles are measured, the shape factor for each particle is calculated according to the above-described formula and the average value is obtained. Namely, the shape factor SF1 in the invention is obtained by analyzing images observed by an optical microscope, by Ruzex image analysis apparatus.

As the method of controlling this shape factor SF1 to be 115 to 140, a method of shaping toner particles obtained by a kneading grinding method into spherical form by hot air can also be used, however, it is preferable to produce a toner by a wet production method (emulsion aggregation method) described later from the standpoint of production stability.

The toner of the invention has a volume average particle size $D_{50V}$ of 2 to 9 μm, preferably of 3 to 8 μm, and more preferably of 4 to 7 μm. By controlling this volume average particle size $D_{50V}$ within the above-mentioned range, not only transferring property is improved as described above but also chargeability can also be improved.

The toner of the invention preferably has a volume-average particle size distribution index (GSDv) of 1.25 or less. When the index is 1.25 or less, the sharpness and resolution of images are further improved.

The average particle size distribution is defined as follows. In a particle size range divided based on particle size distribution measured by a measuring apparatus such as Coulter counter TAII (manufactured by Nikkaki K.K.), Multisizer II (manufactured by Nikkaki K.K.) and the like (Division number: A range from 1.26 to 50.8 μm is divided into 16 channels at an interval of 0.1 based on log scale. Specifically, division is so conducted that particle size range of channel 1 is from 1.26 μm or more and less than 1.59 μm, that of channel 2 is from 1.59 μm or more and less than 2.00 μm, that of channel 3 is from 2.00 μm or more and less than 2.52 μm, and log values of the lower limits of respective channels are (log 1.26=) 0.1, (log 1.59=) 0.2, 0.3, . . . 1.6), cumulative distributions of volume and number are drawn from the smaller size side, and the particle sizes at a cumulation of 16% are defined as volume $D_{16V}$, and number $D_{16P}$, the particle sizes at a cumulation of 50% are defined as volume $D_{50V}$, and number $D_{50P}$, and the particle sizes at a cumulation of 84% are defined as volume $D_{84V}$, and number $D_{84P}$. Using these data, volume-average particle size distribution index (GSDv) is calculated as the square root of the ratio of the particle size at a cumulation of 84% to that at a cumulation 16% in the volume particle size distribution, namely, as $(D_{84V}/D_{16V})^{1/2}$. The number-average particle size distribution index (GSDp) is calculated as $(D_{84P}/D_{16P})^{1/2}$.

The toner of the invention has an absolute value of the charge amount in the range preferably from 10 to 50 μC/g, and more preferably from 15 to 35 μC/g. When the charge amount is less than 10 μC/g, blur in the background portions tends to occur, and when it exceeds 50 μC/g, image density may decrease. The ratio of charge amount under high humidity of 80 RH % at 30° C. to charge amount under low humidity of 20 RH % at 10° C. is preferably from 0.5 to 1.5, and more preferably from 0.7 to 1.2. When this ratio lies within this range, a sharp image can be obtained without being influenced by environment. In particular, the toner of the invention is preferable negative-chargeable.

The toner of the invention has a molecular weight distribution represented by the ratio (Mw/Mn) of the weight-average molecular weight (Mw) to the number-average molecular weight (Mn) measured by using gel permeation chromatography within the range of preferably from 1.5 to 30, and more preferably from 2.5 to 20. When the molecular weight distribution represented by the above-mentioned ratio (Mw/Mn) exceeds 30, gloss (glossiness) of a fixed image may decrease, consequently, light permeability and coloring property are not sufficient, and in the case of development or fixation of a toner for developing electrostatic latent images on a film, an image projected by light permeation is a non-sharp dark image or a projected image which is non-permeable and does not develop color, and the molecular weight distribution is less than 1.5, decrease in viscosity of a toner at the time of fixing at higher temperature is remarkable, and offset phenomenon tends to occur, and consequently, usable temperature range may narrow. On the other hand, when the molecular weight distribution represented by the above-mentioned ratio (Mw/Mn) lies within the above-mentioned numerical value range, light permeability and coloring property are sufficient, and additionally, decrease in viscosity of a toner for developing electrostatic latent images at the time of fixing at higher temperature can be prevented, and generation of offset phenomenon can be suppressed efficiently.

The molecular weight distribution is a value obtained under the following conditions. HLC-8120GPC, SC-8020 manufactured by Tosoh Corporation was used, TSK gei, Super HM-H (6.0 mm ID×15 cm×2) was used as a column, and THF (tetrahydrofuran) was used as an eluent. The experiment conditions include a sample concentration of 0.5%, a flow rate of 0.6 ml/min, a sample injection amount of 10 μl and a measurement temperature of 40° C., and the calibration curve was made from 10 samples of A-500, F-1, F-10, F-80, F-380, A-2500, F-4, F-40, F-128 and F-700. The data collection interval in sample analysis was 300 ms.

The toner of the invention will be illustrated below together with a suitable production method thereof.

It is preferable that the toner of the invention is obtained by a wet production method comprising an aggregation process of forming aggregated particles in a dispersion prepared by dispersing resin fine particles and colorant particles, to prepare an aggregated particle dispersion, and a coalescence process of coalescing the aggregated particles by heating the aggregated particle dispersion (hereinafter, this wet production method is referred to as "emulsion aggregation method" in some cases). Since small particle size toners having the above-mentioned sharp particle size distribution can be obtained easily and full color images of high image quality can be formed, the emulsion aggregation method is preferable.

Further, between the aggregation process and the coalescence process, a process (adhesion process) may be provided in which a fine particle dispersion containing fine particles is added into and mixed with the aggregated particle dispersion to allow the fine particles to adhere to the aggregated particles. In the adhesion process, the fine particle dispersion is added into and mixed with the aggregated particle dispersion prepared in the aggregation process to allow the fine particles to adhere to the aggregated particles, however, since the fine particles added are those newly added to the aggregated particles in view of aggregated particles' standpoint, these fine particles are described as "additional fine particles" in some cases in this specification. As the additional fine particles, releasing agent fine particles, colorant fine particles and the like may be used alone or in combination of two or more, in addition to the resin fine particles. The method of adding and mixing the fine particle dispersion is not particularly restricted, and for example, may be continuously conducted gradually, or may be divided in several steps and effected gradually. By thus adding and mixing fine particles (additional fine particles), generation of minute particles can be suppressed, and sharp particle size distribution of the resulted toners for developing electrostatic latent images can be formed, contributing to high image quality. Further, by providing the adhesion process, a pseudo-shell structure can be formed, exposure of inner additives such as colorant and releasing agents and the like onto the toner surface can be decreased, resultantly, chargeability and life can be improved, and particle size distribution can be maintained at the time of coalescing in the coalescence process and variation thereof can be suppressed, and addition of additives such as surfactants and bases or acids and the like for enhancing stability at the time of coalescing can be omitted or the addition amount thereof can be suppressed to the minimum level, leading to reduction in cost and improvement of quality. Therefore, when a releasing agent is used, it is preferable to add additional fine particles essentially composed of resin fine particles. By use of this method, the form of a toner can be controlled simply by adjusting temperature, stirring frequency, pH and the like, in the coalescence process.

The resin fine particles and additional fine particles used in the aggregation process are formed of a thermoplastic polymer used as a binding resin. Examples thereof include homopolymers of monomers such as styrenes such as styrene, p-chlorostyrene, α-methylstyrene and the like, esters having a vinyl group such as methyl acrylate, ethyl acrylate, n-propyl acrylate, lauryl acrylate, 2-ethylhexyl acrylate, methyl methacrylate, ethyl metharylate, n-propyl methacrylate, lauryl methacrylate, 2-ethylhexyl methacrylate and the like, vinylnitriles such as acrylonitrile, methacrylonitrile and the like, vinyl ethers such as vinyl methyl ether, vinyl isobutyl ether and the like, vinyl ketones such as vinyl methyl ketone, vinyl ethyl ketone, vinyl isopropenyl ketone and the like, polyolefins such as ethylene, propylene, butadiene and the like, or copolymers obtained by combining two or more of them, or mixtures thereof, further, epoxy resins, polyester resins, polyurethane resins, polyamide resins, cellulose resins, polyether resins and the like, non-vinyl condensate resins, or mixtures of these resins with the above-mentioned vinyl resins, and graft polymers obtained by polymerizing vinyl monomers in the co-presence of these polymers, and the like. These resins may be used alone or in combination of two or more. Among these resins, vinyl resins are particularly preferable. The vinyl resin is advantageous since a resin fine particle dispersion can be made easily by emulsion polymerization or seed polymerization using an ionic surfactant and the like.

The method of preparing a dispersion of resin fine particles is not particularly restricted and methods can be appropriately selected depending on the object, and for example, the dispersion can be prepared as described below.

When the resin of the resin fine particles is a homopolymer or copolymer (vinyl resin) of vinyl monomers such as the above-mentioned esters having a vinyl group, the above-mentioned vinylnitriles, the above-mentioned vinyl ethers, the above-mentioned vinyl ketones, and the like, it is possible to prepare a dispersion composed of an ionic surfactant and resin fine particles dispersed therein made of a homopolymer or copolymer of vinyl monomers (vinyl resin), by emulsion-polymerizing or seed-polymerizing the above-mentioned vinyl monomers in the ionic surfactant. In contrast, when the resin of the resin fine particles is a resin other than the homopolymer or copolymer of vinyl monomers and can be dissolved in an oily solvent having relatively low solubility in water, it is possible to prepare the dispersion of the resin fine particles by dissolving this resin in the oily solvent, adding the resultant solution to water together with an ionic surfactant and a polymer electrolyte, finely dispersing the resultant mixture using a dispersing machine such as a homogenizer or the like, and heating or applying reduced pressure to the dispersion to evaporate the oily solvent.

When the resin fine particles dispersed in the resin fine particle dispersion are complex particles containing a component other than the resin fine particles, a dispersion containing these complex particles can be prepared, for example, by a method in which components of the complex particles are dissolved or dispersed in a solvent, the resultant solution or dispersion is dispersed in water together with a suitable dispersant as described above, and the solvent is removed by heating or applying reduced pressure to the resultant dispersion, or a method in which components are fixed by using mechanical shear force or by electric adsorption on the surface of latex produced by emulsion polymerization and seed polymerization. Further, complex resin particles produced by adding a colorant and releasing agent at the time of producing resin fine particles may be used.

The central size (median size) of the resin fine particle is, in terms of number-average particle size $D_{50n}$, 1 μm or less, preferably from 50 to 400 nm, and more preferably from 70 to 350 nm. When the average particle size of the resin fine particle is large, the particle size distribution of the finally obtained toner for developing latent images having an electrostatic charge is broaden, and free particles are generated, leading to decrease in performance and reliability. In contrast, when the median size is too small, the solution viscosity at the time of producing a toner increases, and the particle size distribution of the finally obtained toner is broaden in some cases. When the average particle size of the resin fine particles lies within the above-mentioned range, the above-mentioned defects are not present, and further, uneven distribution between toners decreases, dispersion in a toner becomes excellent, and irregularity in performance and reliability lowers.

The average particle size of the resin fine particles can be measured by, for example, laser diffraction type particle size distribution measuring apparatuses (LA-700manufactured by Horiba Ltd.; Micro Track UPA9340 manufactured by Nikkiso Co., Ltd.) and the like.

In producing the toner of the invention by the emulsion aggregation method, the average particle size of colorant particles in a colorant particle dispersion is, in terms of number-average particle size $D_{50n}$, referably 0.5 μm or less, more preferably from 0.05 to 0.5 μm, and further preferably from 0.1 to 0.3 μm. When the average particle size of the colorant particles exceeds 0.5 μm, the particle size distribution of the finally obtained toner for developing latent images having an electrostatic charge is broaden, and free particles are generated, leading to decrease in performance and reliability. When the average particle size of the colorant particles is less than 0.05 μm, not only coloring property in a toner lowers but also shape controlling property which is one character of the emulsion aggregation method is deteriorated, leading to impossibility of obtaining a toner having a shape near real sphere. The number % of particles of 0.5 μm or more is preferably less than 10%, and preferably substantially 0%. Presence of such coarse particles deteriorates stability in the aggregation process, and causes not only liberation of coarse colored particles but also broadening of particle size distribution. The number % of particles of 0.03 μm or less is preferably 5 number % or less. Presence of such fine particles deteriorates shape controlling property in the coalescence process, and so-called smooth particles having a shape factor SF1 of 135 or less cannot be obtained. In contrast, when the average particle size of colorant particles, and the number % of the coarse particles and fine particles are within the above-mentioned ranges, the above-mentioned defects are not present, uneven distribution between toners decreases, dispersion in a toner becomes excellent, and irregularity in performance and reliability lowers. In the invention, the addition amount of a colorant is preferably 3 to 15% by mass based on toner particles.

The average particle size of the colorant particles can be measured by a micro track (Micro Track UPA9340 manufactured by Nikkiso Co., Ltd.)

The toner of the invention can contain also a releasing agent for the purpose of improving fixing property and image preservability. As the releasing agent, substances having a melting point of 70 to 120° C., having a main maximum heat absorption peak measured according to ASTM D3418-8 lying within the range from 50 to 140° C., and having a melt viscosity of 0.1 to 5000 centipoise (0.001 to 5 Pa·s) at 150° C. are preferable, and those having a melt viscosity of 1 to 1000 centipoise (0.01 to 1 Pa·s) are more preferable. When the melting point is less than 70° C., the wax change temperature is too low, and blocking resistance may be poor, or developing property may deteriorate when the temperature in a copying machine increases. When the melting point exceeds 120° C., the wax change temperature is too high, and fixing may be conducted at higher temperatures, which is not desirable from the standpoint of energy saving. At melt viscosity higher than 5000 centipoise (5 Pa·s), elution of the releasing agent from a toner is weak, and fixing and releasing property may be insufficient. On the other hand, when melt viscosity is lower than 0.1 centipoise (0.001 Pa·s), exposure amount of a releasing agent onto the toner surface may be too large, and chargeability and life may decrease.

It is desirable that the releasing agent has a heat absorption initiation temperature of 40° C. or higher in a DSC curve measured by a differential scanning calorimeter (DSC). This temperature is more preferably 50° C. or higher. When it is less than 40° C., aggregation of toners occurs in a copying machine and in a toner bottle. The heat absorption initiation temperature varies depending on lower molecular weight wax in the molecular weight distribution of the wax, and the kind and the amount of polar groups in the structure thereof. In general, when molecular weight of the wax increases, also the heat absorption initiation temperature increase together with the melting temperature, however, lower melting temperature and lower viscosity inherent to wax may be deteriorated. Therefore, it is effective to remove those having lower molecular weights in the molecular weight distribution of wax, and examples of the method for this include molecule distillation, solvent fractionation, gas chromatograph fractionation and the like. When the maximum heat absorption peak is lower than 50° C., offset tends to occur at the time of fixation. In contrast, when the peak exceeds 140° C., fixation temperature increases, and smoothness on the surface of a fixed image is not obtained, deteriorating glossiness. Measurement of DSC is conducted, for example, using DSC-7 manufactured by Perkin Elmer. For temperature correction of a detection part of an apparatus, the melting points of indium and zinc are utilized, and for correction of calorie, the heat of fusion of indium is used. As the sample, an aluminum pan is used, and a vacant pan is set for control, and measurement is conducted at a temperature rising rate of 10° C./min.

Specific examples of the releasing agent include polyolefins having lower molecular weights such as polyethylene, polypropylene, polybutene and the like; silicones which soften when heated; fatty amides such as oleic amide, erucic amide, ricinoleic amide, stearic amide and the like; vegetable waxes such as carnauba wax, rice wax, candelilla wax, Japan tallow, jojoba wax and the like; animal waxes such as bees wax and the like; mineral/petroleum waxes such as montan wax, ozokerite, ceresin, paraffin wax, micro crystalline wax, Fischer-Tropsch wax and the like; and modified substances thereof, and the like. The above-mentioned releasing agent can be dispersed in water together with an ionic surfactant and a polymer electrolyte such as a polymer acid or polymer base and the like, heated at the melting point or higher, dispersed in the form of fine particles by a homogenizer or a pressure discharge type dispersing machine (Gaulin homogenizer, manufactured by Gaulin) having an ability of imparting strong shearing force, to produce a dispersion of particles of 1 μm or less. The particle size of the above-mentioned releasing agent particle dispersion is measured by, for example, a laser diffraction type particle size distribution measuring apparatuses (LA-700 manufactured by Horiba Ltd.).

The addition amount of the releasing agent is preferably 20% by mass or less based on a toner. When the amount of the releasing agent is too large, the amount of a releasing agent exposed on the toner surface or liberated out of a toner increases, the flowability and preservability of a toner itself become problematical, and deterioration of reliability occurs such as generation of filming and the like in some cases. In the case of combination with oil-less fixation, it is preferable that the above-mentioned releasing agent is contained in an amount of 6% by mass or more. When the amount of the releasing agent is too small, hot offset occurs, and releasability from a fixing apparatus lowers in some cases.

Inorganic or organic fine particles can be added to the toner of the invention. These fine particles can improve dispersibility of inner additives such as a colorant, releasing agent and the like. Further, the storage elastic modulus of a toner increases due to reinforcing effect of fine particles, and offset resistance and releasability from a fixing apparatus are improved in some cases. As the inorganic fine particle, silica, alumina, titania, calcium carbonate, magnesium carbonate, tricalcium phosphate and the like can be used alone or in combination. Among them, silica is preferably used from the standpoint of OHP (over head projector) transparency. Though fine particles can be added directly at the time of producing a toner, it is preferable to use a dispersion prepared previously by dispersing fine particles in a water-soluble medium such as water and the like in order to enhance dispersibility. In dispersion, dispersibility can also be improved by using an ionic surfactant, polymer acid, polymer base and the like.

Other known materials such as a charge controlling agent and the like may also be added to the toner of the invention.

The average particle size of the material added is required to be 1 μm or less, and it is preferably from 0.01 to 1 μm. When the average particle size exceeds 1 μm, the particle size distribution of the finally obtained toner for developing latent images having an electrostatic charge is broaden, or free particles are generated, and decrease in performance and reliability may be caused. On the other hand, when the average particle size is within the above-mentioned range, the above-mentioned defects are not present, uneven distribution between toners decreases, dispersion in a toner becomes excellent, and irregularity in performance and reliability lowers. The average particle size can be measured by using, for example, a micro track and the like.

In the toner of the invention, examples of the dispersing medium in the resin fine particle dispersion, colorant dispersion and a dispersion containing other components (particles)include aqueous media and the like. Examples of the aqueous medium include water such as distilled water, ion exchanged water and the like, alcohols and the like. These may be used alone or in combination of two or more.

In the toner of the invention, the means for producing various dispersions is not particularly restricted, and examples thereof include dispersion apparatuses known per se such as a rotation shearing type homogenizer, ball mill having media, sand mill, dyno-mill and the like.

In the toner of the invention, it is preferable that a surfactant is added to and mixed with, as an aggregating agent, to an aqueous medium. As the surfactant, for example, anionic surfactants such as sulfate salt type surfactants, sulfonate type surfactants, phosphate type surfactants, soap type surfactants and the like; cationic surfactants such as amine salt type surfactants, quaternary ammonium salt type surfactants and the like; nonionic surfactants such as polyethylene glycol type surfactants, alkylphenol ethylene oxide adducts type surfactants, polyhydric alcohol type surfactants and the like, are suitably used. Among them, ionic surfactants are preferable, and anionic surfactants and cationic surfactants are more preferable. The nonionic surfactants are preferably used together with the anionic surfactants or cationic surfactants. The surfactants may be used alone or in combination of two or more.

Specific examples of the anionic surfactant include fatty acid soaps such as potassium laurate, sodium oleate, sodium castor oil ad the like; sulfates such as octyl sulfate, lauryl sulfate, lauryl ether sulfate, nonyl phenyl ether sulfate and the like; sodium alkylnaphthalene sulfonates such as laurylsulfonate, dodecylsulfonate, dodecylbenzenesulfonate, triisopropylnaphthalenesulfonate, dibutylnaphthalenesulfonate and the like; sulfonates such as naphthalenesulfonate formalin condensate, monooctylsulfosuccinate, dioctylsulfosuccinate, lauric amide sulfonate, oleic amid sulfonate and the like; phosphates such as lauryl phosphate, isopropyl phosphate, nonyl phenyl ether phosphate and the like; sodium dialkylsulfosuccinates such as sodium dioctylsulfosuccinate and the like; sulfosuccinates such as disodium lauryl sulfosuccinate, disodium lauryl polyoxyethylenesulfosuccinate and the like.

Specific examples of the cationic surfactant include amine salts such as laurylamine hydrochloride, stearylamine hydrochloride, oleylamine hydrochloride, stearylamine acetate, stearylaminopropylamine acetate and the like; quaternary ammonium salts such as lauryl trimethyl ammonium chloride, dilauryl dimethyl ammonium chloride, distearyl ammonium chloride, distearyl dimethyl ammonium chloride, lauryl dihydroxyethyl methyl ammonium chloride, oleyl bispolyoxyethylene methyl ammonium chloride, lauroyl aminopropyl dimethyl ethyl ammonium ethosulfate, lauroyl aminopropyl dimethyl hydroxyethyl ammonium perchlorate, alkylbenzene dimethyl ammonium chloride, alkyl trimethyl ammonium chloride and the like.

Specific examples of the nonionic surfactant include alkyl ethers such as polyoxyethylene octyl ether, polyoxyethylene lauryl ether, polyoxyethylene stearyl ether, polyoxyethylene oleyl ether and the like; alkyl phenyl ethers such as polyoxyethylene octylphenyl ether, polyoxyethylene nonylphenyl ether and the like; alkyl esters such as polyoxyethylene laurate, polyoxyethylene stearate, polyoxyethylene oleate and the like; alkylamines such as polyoxyethylene laurylamino ether, polyoxyethylene stearylamino ether, polyoxyethylene oleylamino ether, polyoxyethylene soy bean amino ether, polyoxyethylene beef tallow amino ether and the like; alkylamides such as polyoxyethylene lauric amide, polyoxyethylene stearic amide, polyoxyethylene oleic amide and the like; vegetable oil ethers such as polyoxyethylene castor oil ether, polyoxyethylene rapeseed oil ether and the like; alkanolamides such as lauric diethanolamide, stearic diethanolamide, oleic diethanolamide and the like; sorbitan ester ethers such as polyoxyethylene sorbitan monolaurate, polyoxyethylene sorbitan monopalmitate, polyoxyethylene sorbitan monostearate, polyoxyethylene sorbitan monooleate and the like.

In the aggregation process, a dispersion prepared by mixing at least a resin fine particle dispersion and a colorant particle dispersion, and, if necessary, other components such as a releasing agent dispersion and the like is heated at a temperature which is between room temperature and the glass transition temperature of the resin +5° C. while the dispersion is stirred to aggregate the resin fine particles and colorant and the like, and thus aggregated particles are formed. The average particle size of the aggregated particles is preferably 2 to 9 μm. resin fine particles (additional fine particles) may be additionally added to thus formed aggregated particles in order to form a coating layer on the surface of the aggregated particle (adhesion process). Subsequently, in the coalescence process, for example, aggregated particles are coalesced by heating them at a temperature not lower than the softening point of the resin, generally from 70 to 120° C., to obtain a toner particle-containing solution (toner particle dispersion). Next, the resulted toner particle-containing solution is treated by centrifugal separation or suction filtration, to separate toner particles, and the obtained toner particles are washed once to three times with ion exchanged water. In this procedure, washing effect can be further enhanced by controlling pH. Thereafter, the toner particles are filtrated, and washed once to three times with ion exchanged water, and dried, to obtain the toner of the invention.

Inorganic particles and organic particles can be added to the toner of the invention as a flowability aid, cleaning aid, polishing agent and the like. Examples of the inorganic particles are, for example, all particles usually used as external additives on the toner surface such as silica, alumina, titania, calcium carbonate, magnesium carbonate, tricalcium phosphate, cerium oxide and the like, and examples of the organic particles are, for example, all particles usually used as external additives on the toner surface such as vinyl resins, polyester resins, silicone resins, fluorine-containing resins and the like. Further, a lubricant can also be added. Examples of the lubricant include fatty amides such as ethylenebisstearic amide, oleic amide and the like, fatty acid metal salts such as zinc stearate, calcium stearate and the like. Among the inorganic particle, it is preferable to add hydrophobic silica as an essential component.

In order to obtain a toner of other color having the same constitution as that of the toner of the invention, colorants listed below can be used.

As the black pigment, carbon black, copper oxide, manganese dioxide, aniline black, activated carbon, non-magnetic ferrite, magnetite and the like can be used, and particularly, carbon black is preferably used. As the yellow pigment, chrome yellow, zinc chrome, yellow iron oxide, cadmium yellow, chromium yellow, hansa yellow, hansa yellow 10G, benzidine yellow G, benzidine yellow GR, threne yellow, quinoline yellow, permanent yellow NCG and the like can be used, and particularly, C. I. Pigment yellow 17, C. I. Pigment yellow 74, C. I. Pigment yellow 97, C. I. Pigment yellow 180, C. I. Pigment yellow 185 and the like are preferably used. As the magenta pigment, red iron oxide, cadmium red, read lead, mercury sulfide, watch young red, permanent red 4R, lithol red, brilliant carmine 3B, brilliant carmine 6B, DuPont oil red, pyrazolone red, rhodamine B lake, lake red C, rose Bengal, eoxin red, alizarin lake and the like can be used. These magenta pigments can be used together with the pigment represented by the general formula (1). As the cyan pigment, ultramarine, cobalt blue, alkali blue lake, Victoria blue lake, fast sky blue, indanethrene blue BC, aniline blue, ultramarine blue, chalcoyl blue, methylene blue chloride, phthalocyanine blue, phthalocyanine green, malachite green oxalate and the like can be used, and particularly, C. I. Pigment blue 15:1, C. I. Pigment blue 15:3 and the like are preferably used. As the orange pigment, red chrome yellow, molybdenum orange, permanent orange GTR, pyrazolone orange, vulcan orange, benzidine orange G, indanethrene brilliant orange PK, indanetherene brilliant orange GK and the like can be used. As the violet pigments, manganese violet, fast violet B, methyl violet lake and the like can be used. As the green pigment, chromium oxide, chromium green, pigment green, malachite green lake, final yellow green G and the like can be used. As the white pigment, zinc white, titanium oxide, antimony white, zinc sulfide and the like can be used. As the extender, baryte powder, barium carbonate, clay, silica, white carbon, talc, alumina white and the like can be used. Further, various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, xanthene dyes and the like are also used. These colorants are used alone or in admixture.

A dispersion of colorant particles is prepared by dispersing the colorant in a solvent with a rotation shearing type homogenizer, or a media type dispersing machine such as a ball mill, sand mill, attritor or the like, a high pressure facing impact type dispersing machine, and the like. The colorant can also be dispersed with a surfactant having polarity in an aqueous system by a homogenizer. In this operation, light permeability and color developing property are excellent when the average particle size of the colorant is from 100 to 330 nm.

These colorants are selected from the standpoints of hue angle, chroma, brightness, weather resistance, OHP permeability, and dispersability in toners. The colorant can be added in an amount of 4 to 15% by weight based on the total amount of solid components constituting the toner. When a magnetic body is used as a black colorant, it can be added in an amount of from 12 to 240% by weight, differing from other colorants. Specifically, a substance which is magnetized in magnetic field is used as the magnetic body, and examples thereof include powders of ferromagnets such as iron, cobalt, nickel and the like, or compounds such as ferrite, magnetite and the like. In the invention, when a toner is obtained in an aqueous phase, it is necessary to pay attention to the property of a magnetic body of shifting to the aqueous phase, and preferably, the surface of the magnetic body is previously improved, and for example, treatment for making the magnetic body hydrophobic and the like are preferably conducted previously.

Developer for Electrostatic Charge Image

The developer of the invention is not particularly restricted as long as it contains the magenta toner for electrophotography of the invention, and an appropriate composition may be used depending on the object. For example, the magenta toner for electrophotography of the invention may be used alone as a one-component type developer, or it may also be combined with a carrier to provide a two-component type developer.

The carrier is not particularly restricted, and carriers known per se such as iron powder carriers, ferrite carriers and the like can be used. For example, known carriers such as resin-coated carriers described in JP-A Nos. 62-39879, 56-11461 and the like, can be used. The mixing ratio of the above-mentioned toner for developing latent images having an electrostatic charge of the invention to the carrier is not particularly restricted, and can be appropriately selected depending on the object.

Image Forming Method

The image forming method of the invention is a full color image forming method comprising the steps of: forming an electrostatic latent image on a photoreceptor; developing the electrostatic latent image using a developer containing a toner, to form a toner image; transferring the toner image onto a recording medium; and thermally fixing the toner image on the recording medium, and the above-mentioned magenta toner for electrophotography of the invention is used as one of the toners.

In the image forming method of the invention, the above-mentioned steps are general steps and described, for example, in JP-A Nos. 56-40868 and 49-91231, and can be suitably applied to the present specification. The image forming method of the invention can be carried out using image formation apparatuses such as a copying machine, facsimile and the like known per se. Further, the step of transferring a toner image onto a recording medium may be conducted by a mode in which a toner image on a photoreceptor is directly transferred onto a recording medium, or a mode in which a toner image on a photoreceptor is transferred via an intermediate transferring body onto a recording medium.

The image forming method of the invention can be applied also to an electrophotographic method containing a toner recycling step. The toner recycling step is a step in which a toner recovered in a cleaning step is returned to a developer. Further, the toner recycling step can be applied also to a recycling system in which a cleaning process is omitted, and a toner is recovered simultaneously with development.

In the image forming method of the invention, the step of thermally fixing a toner image can be conducted using a known contact type thermal fixation apparatus, and specifically, a heat roller fixation apparatus equipped with a fixation member composed of a heat roller having a rubber elastic layer on a core metal and having, if necessary, a fixation member surface layer, and of a press roller having a rubber elastic layer on a core metal and having, if necessary, a fixation member surface layer, and fixation apparatuses having a combination of a roller and a belt, or a combination of a belt and a belt instead of such a combination of a roller and a roller, as the fixation member, can be used, for example. The fixation apparatus may be, if necessary, equipped with a means of applying a releasing oil such as a silicone oil and the like to the fixation member.

As the substrate (core) of the fixation member, a material which has excellent heat resistance, does not transform easily, and has excellent heat conductivity is selected, and in the case of a roll type fixation member, for example, aluminum, iron, copper or the like s selected, and in the case of a belt type fixation member, for example, those having high heat resistance and high durability such as a polyimide film, polyamideimide film, stainless belt or the like is selected. Heat resistant rubbers such as silicone rubber, fluororubber and the like are used as the rubber elastic layer, and the rubber hardness thereof is preferably from 10 to 80° in terms of Ascar C hardness. When hardness is too low, durability is poor, and when hardness is too high, deformation of a roll is insufficient, leading to poor fixing property in some cases. The thickness thereof is preferably from 0.05 mm to 5 mm. When the thickness is too small, deformation is insufficient, leading to poor fixing property in some cases, and when too large, longer time is necessary for heating, giving poor practicability in some cases. Silicone rubber, fluororubber, fluorine-containing latex and fluororesin are used as the fixation member surface layer, and use of a fluororesin among them can provide fixing performance of high reliability for a long period of time. Teflon such as PFA (perfluoroalkoxy ethyl ether copolymer), and soft fluororesins containing vinylidene fluoride and the like can be used as the fluororesin which is used as the fixation member surface. Since fluororesins do not reveal decrease in releasability due to adhesion and deposition of toner to a fixation member and the like as compared with silicone rubber and fluororubber, if releasability of the toner is sufficient, the life of the fixation member can be elongated. The thickness of the fixation member surface layer is preferably from 1.0 $\mu$m to 80 $\mu$m. When the thickness is too small, durability is poor, and when too large, deformation is insufficient, and fixing property is deteriorated in some cases. The above-mentioned fixation member may contain various additive and the like depending on the object, and for example, may contain carbon black, metal oxide, and ceramics particles such as SiC and the like for the purpose of improving wear resistance and controlling resistivity and the like.

In the image forming method of the invention, it is particularly preferable to use a fixation apparatus equipped with a fixation member composed of a pair of rotation members coming into contact with the respective surfaces of a recording medium while the recording medium is put therebetween in which fixation apparatus at least one of the pair of rotation members is a belt member (fixation apparatuses containing as the fixation member a combination of a roller and a belt or a combination of a belt and a belt). By thermally fixing a toner image formed of the magenta toner for electrophotography of the invention, by this fixation apparatus, toner permeation phenomenon can be further suppressed, and an image of high image quality can be formed more suitably. Though the reason for this is not apparent, it is hypothesized that, if a fixation apparatus having a belt member as the fixation member is used, time for heating a toner can be made longer, consequently, heating temperature can be lowered as compared with a roller/roller mode, resultantly, fixation can be conducted when the viscosity of a toner is sufficiently high, and therefore, generation of the permeation phenomenon can be suppressed.

It is preferable to use, as the fixation apparatus which has member as the fixation member a belt, a fixation apparatus having a belt type press system composed of a heat roller having an elastic layer and, as a surface layer, a fluororesin layer on a core material as described above, a belt composed of a polyimide film and the like, and a press member pressing the heat roller from inside of the belt. It is preferable that the above-mentioned belt type press system is heated at a temperature lower than that of the heat roll or not heated. Though a releasing oil need not necessarily be applied to this fixation member, it is preferable that a releasing agent is applied to the fixation member from the standpoints of durability and reliability.

The amount of a releasing oil applied to the fixation member is preferably from $1.6\times10^{-6}$ to $8.0\times10^{-4}$ mg/cm$^2$. It is preferable that the application amount of a releasing oil is small, however if the feeding amount of the releasing oil is 0 mg/cm$^2$, when the fixation member comes into contact with a recording medium such as paper and the like during the fixation step, the wear amount of the fixation member increases and durability of the fixation member lowers in some cases. Therefore, it is preferable from the practical standpoint that the releasing oil is fed in a slight amount to the fixation member. On the other hand, when the feeding amount of the releasing oil exceeds $8.0\times10^{-4}$ mg/cm$^2$ (0.5 mg per A4 paper), image quality after fixation deteriorates because of the releasing oil adhered to the image surface, and particularly in the case of OHP and the like utilizing permeation light, image quality may deteriorate remarkably.

The feeding amount of the releasing agent is measured as described below. Namely, when plain paper used in ordinary copying machines (typically, copying paper manufactured by Fuji Xerox, trade name: J paper) passes through a fixation member on which surface a releasing oil has been fed, the releasing oil adheres onto the plain paper. This releasing oil on the plain paper is extracted using a Soxhlet extraction instrument. Hexane is used as a solvent. The releasing oil contained in hexane is quantified by an atomic absorption analysis apparatus, to quantify the amount of the releasing oil adhered to the plain paper. This amount is defined as the feeding amount of the releasing oil to the fixation member. The releasing oil is not particularly restricted, and examples thereof include heat resistant oils, for example, liquid releasing oils such as dimethylsilicone oil, fluorine-containing oil, fluorosilicone oil, modified oils such as amino-modified silicone oil and the like. Use of a fluorine-containing oil or fluorosilicone oil as a releasing oil is not practical from the standpoint of cost since the feeding amount of this releasing oil can not be reduced in the case of conventional image forming methods. However, in the case of the image forming method of the invention, such a use is not practically problematical even from cost standpoint since the feeding amount of the releasing oil can be reduced significantly. The method of feeding the releasing oil to the surface of the heat roller in the heat pressing apparatus is not particularly restricted, and examples thereof include a pad mode in which a liquid releasing agent is impregnated, aweb mode, rollermode, and anon-contact type shower mode (spray mode) and the like. Among them, the web mode and roller mode are preferable. These modes are advantageous in that the releasing agent can be fed uniformly, and the feeding amount can be controlled easily. It is necessary to use a blade and the like separately in order to feed the releasing oil uniformly on the entire surface of the fixation member according to the shower mode.

In the image forming method of the invention, examples of the recording medium (recording material) include plain paper and OHP sheet and the like usually used in copying machines, printers and the like of electrophotographic mode, and the like. When paper having a surface smoothness of 15 to 80 seconds such as recycled paper and the like is used, a more excellent effect of the invention can be obtained. The surface smoothness is measured according to JIS-P 8119.

EXAMPLES

The present invention will be illustrated further specifically below by referring to examples, but, the scope of the invention is not limited to these examples.

In producing toners in the examples, a resin fine particle dispersion, colorant particle dispersion and releasing agent particle dispersion are prepared and mixed with each other in a predetermined ratio, and a metal salt aggregating agent is added to the resultant mixture in order to neutralize the mixture while the mixture is stirred. Thus aggregated particles are formed. Subsequently, an inorganic hydroxide is added to the aggregated particle dispersion to control pH of the system to be weakly acidic or neutral, and then the aggregated particles are coalesced and integrated by heating the dispersion at a temperature of not less than the glass transition temperature of the resin fine particles. After completion of the reaction, a desired toner is obtained via steps of sufficient washing, solid-liquid separation, and drying. Methods of preparing the above-mentioned dispersions are described below.

Preparation of Resin Fine Particle Dispersion (L1)

| | |
|---|---|
| - Oil phase 1 - | |
| Styrene (manufactured by Wako Pure Chemical Industries Ltd.) | 15.3 parts by mass |
| n-Butyl acrylate (manufactured by Wako Pure Chemical Industries Ltd.) | 0.46 parts by mass |
| β-carboethyl acrylate (manufactured by Rhodia Nicca, Ltd.) | 0.6 parts by mass |
| Dodecane thiol (manufactured by Wako Pure Chemical Industries Ltd.) | 0.2 parts by mass |
| - Oil phase 2 - | |
| Styrene (manufactured by Wako Pure Chemical Industries Ltd.) | 15.3 parts by mass |
| n-Butyl acrylate (manufactured by Wako Pure Chemical Industries Ltd.) | 0.46 parts by mass |
| β-carboethyl acrylate (manufactured by Rhodia Nicca, Ltd.) | 0.6 parts by mass |
| Dodecane thiol (manufactured by Wako Pure Chemical Industries Ltd.) | 0.4 parts by mass |
| - Aqueous phase 1 - | |
| Ion exchanged water | 17.5 parts by mass |
| Anionic surfactant (manufactured by Rhodia Nicca, Ltd.) | 0.35 parts by mass |
| - Aqueous phase 2 - | |
| Ion exchanged water | 40 parts by mass |
| Anionic surfactant (manufactured by Rhodia Nicca, Ltd.) | 0.05 parts by mass |
| Ammonium persulfate (manufactured by Wako Pure Chemical Industries Ltd.) | 0.3 parts by mass |

The components of the oil phase 1 and half of the components of the aqueous phase 1 are placed in a flask and mixed while stirring to prepare a monomer emulsion 1, and similarly, the oil phase 2 and the remaining half of the aqueous phase 1 are mixed while stirring to prepare a monomer emulsion 2. The components of the aqueous phase 2 are placed in a reaction vessel, and the vessel is heated in an oil bath until the reaction system in the vessel reaches 75° C. while purging the atmosphere in the vessel with nitrogen sufficiently and stirring the components. The monomer emulsion 1 is initially dropped into the reaction vessel over 2 hours, and then the monomer emulsion 2 is dropped thereto over 1 hour to conduct emulsion polymerization. After completion of dropping, polymerization is further continued at 75° C., and 3 hours later polymerization is terminated and thus a resin fine particle dispersion (L1) is prepared. The number-average particle size $D_{50n}$ of the resin fine particles in the resultant dispersion is measured by a laser diffraction type particle size distribution measuring apparatuses (LA-700 manufactured by Horiba Ltd.) and is 290 nm, and the glass transition temperature of the resin is measured using a differential scanning calorimeter (DSC-50, manufactured by Shimadzu Corporation) at a temperature rising rate of 10° C./min and is 52° C., and the number-average molecular weight (in terms of polystyrene) is measured by a gel permeation chromatography molecular weight measuring apparatus (manufactured by Tosoh Corporation, HLC-8020) using THF as a solvent and is 12,000. Then, ion exchanged water is added to the resin fine particle dispersion (L1) to control the solid concentration of the dispersion to be 40%. 3 g of the dispersion is weighed, and heated at 130° C. for 30 minutes to evaporate water, and the solid concentration is calculated from the weight of the remaining dried substance.

Preparation of Resin Fine Particle Dispersion (L2)

| | |
|---|---|
| - Oil phase - | |
| Styrene (manufactured by Wako Pure Chemical Industries Ltd.) | 30 parts by mass |
| n-Butyl acrylate (manufactured by Wako Pure Chemical Industries Ltd.) | 10 parts by mass |
| β-carboethyl acrylate (manufactured by Rhodia Nicca, Ltd.) | 1.3 parts by mass |
| Dodecane thiol (manufactured by Wako Pure Chemical Industries Ltd.) | 0.4 parts by mass |
| - Aqueous phase 1 - | |
| Ion exchanged water | 17.5 parts by mass |
| Anionic surfactant (manufactured by Rhodia Nicca, Ltd.) | 0.35 parts by mass |
| - Aqueous phase 2 - | |
| Ion exchanged water | 40 parts by mass |
| Anionic surfactant (manufactured by Rhodia Nicca, Ltd.) | 0.05 parts by mass |
| Ammonium persulfate (manufactured by Wako Pure Chemical Industries Ltd.) | 0.4 parts by mass |

The components of the oil phase and the components of the aqueous phase 1 are placed in a flask and mixed while stirring to prepare a monomer emulsion. The component of the aqueous phase 2 is added into a reaction vessel and heated in an oil bath until the reaction system in the vessel reaches 75° C. while purging the atmosphere in the vessel with nitrogen sufficiently and stirring the components. The monomer emulsion is dropped into the reaction vessel gradually over 3 hours to conduct emulsion polymerization. After completion of dropping, polymerization is further continued at 75° C., and 3 hours later polymerization is terminated and thus a resin fine particle dispersion (L2) is obtained. The number-average particle size $D_{50n}$ of the resin fine particles in the resultant dispersion is 350 nm, and the glass transition temperature of the resin is 54° C., and the number-average molecular weight measured by GPC is 13,000. Then, the solid concentration of the dispersion is controlled to be 40%.

Preparation of Releasing Agent Fine Particle Dispersion (W1)

| | |
|---|---|
| Polyethylene wax (manufactured by Toyo-Petrolite, Polywax 725, melting point: 103° C.) | 30 parts by mass |
| Cationic surfactant (manufactured by Kao Corp., Sanizol B50) | 3 parts by mass |
| Ion exchanged water | 67 parts by mass |

The above-mentioned components are sufficiently dispersed by a homogenizer (manufactured by IKA, Ultratalax T50) while being heated at 95° C., and then dispersed by a pressure discharge type homogenizer (Gaulin homogenizer, manufactured by Gaulin), to prepare a releasing agent fine particle dispersion (W1). The number-average particle size $D_{50n}$ of the releasing agent fine particles in the resultant dispersion is 310 nm. Thereafter, ion exchanged water is added to the dispersion (W1) to control the solid concentration of the dispersion to be 30%.

| Preparation of magenta pigment dispersion (MN1) | |
|---|---|
| Magenta pigment (manufactured by Sanyo Shikiso K.K., PR238 (naphthol)) | 20 parts by mass |
| Anionic surfactant (manufactured by Dai-itch Kogyo Seiyaku Co., Ltd., Neogen R) | 2 parts by mass |
| Ion exchanged water | 78 parts by mass |

Using a homogenizer (manufactured by LKA, Ultratalax T50), the above-mentioned components are dispersed at 3000 rpm for 2 minutes to allow the pigment to get affinity with water, the mixture is further dispersed at 5000 rpm for 10 minutes, and then the mixture is stirred around the clock by an ordinary stirrer to effect defoaming. Thereafter, the mixture is dispersed under a pressure of 240 MPa for about 1 hour by using a high pressure impact type dispersing machine Altimizer (manufactured by Sugino Machine Limited, HJP30006) to obtain a magenta pigment dispersion (MN1). The number-average particle size $D_{50n}$ of the pigment in the dispersion is 106 nm. Thereafter, ion exchanged water is added to the dispersion (MN1) to control the solid concentration of the dispersion to be 15%.

| Preparation of magenta pigment dispersion (MN2) | |
|---|---|
| Magenta pigment (manufactured by Clariant (Japan) K.K., PR185 (naphthol)) | 20 parts by mass |
| Anionic surfactant (manufactured by Dai-itch Kogyo Seiyaku Co., Ltd., Neogen R) | 2 parts by mass |
| Ion exchanged water | 78 parts by mass |

A magenta pigment dispersion (MN2) is prepared in the same manner as that for the magenta pigment dispersion (MN1) except that the above-described components are used. The number-average particle size $D_{50n}$ of the pigment in the dispersion is 193 nm. Thereafter, ion exchanged water is added to the dispersion (MN2) to control the solid concentration of the dispersion to be 15%.

| Preparation of magenta pigment dispersion (MK1) | |
|---|---|
| Magenta pigment (manufactured by Dainichiseika Colour & Chemicals Mfg. Co., Ltd., PR122 (quinacridone)) | 20 parts by mass |
| Anionic surfactant (manufactured by Dai-itch Kogyo Seiyaku Co., Ltd., Neogen R) | 2 parts by mass |
| Ion exchanged water | 78 parts by mass |

A magenta pigment dispersion (MK1) is prepared in the same manner as that for the magenta pigment dispersion (MN1) except that the above-described components are used. The number-average particle size $D_{50n}$ of the pigment in the dispersion is 113 nm. Thereafter, ion exchanged water is added to the dispersion (MK1) to control the solid concentration of the dispersion to be 15%.

| Preparation of cyan pigment dispersion (C1) | |
|---|---|
| Cyan pigment (manufactured by Dainichiseika Colour & Chemicals Mfg. Co., Ltd., PB15:3) | 20 parts by mass |
| Anionic surfactant (manufactured by Dai-itch Kogyo Seiyaku Co., Ltd., Neogen R) | 2 parts by mass |
| Ion exchanged water | 78 parts by mass |

A cyan pigment dispersion (C1) is prepared in the same manner as that for the magenta pigment dispersion (MN1) except that the above-described components are used. The number-average particle size $D_{50n}$ of the pigment in the dispersion is 121 nm. Thereafter, ion exchanged water is added to the dispersion (C1) to control the solid concentration of the dispersion to be 15%.

| Preparation of yellow pigment dispersion (Y1) | |
|---|---|
| Yellow pigment (manufactured by Clariant (Japan) K.K., PY74) | 20 parts by mass |
| Anionic surfactant (manufactured by Dai-itch Kogyo Seiyaku Co., Ltd., Neogen R) | 2 parts by mass |
| Ion exchanged water | 78 parts by mass |

A yellow pigment dispersion (Y1) is prepared in the same manner as that for the magenta pigment dispersion (MN1) except that the above-described components are used. The number-average particle size $D_{50n}$ of the pigment in the dispersion is 118 nm. Thereafter, ion exchanged water is added to the dispersion (Y1) to control the solid concentration of the dispersion to be 15%.

Example 1

| Production of magenta toner (toner M1) | |
|---|---|
| Resin fine particle dispersion (L1) | 160 parts by mass |
| Releasing agent fine particle dispersion (W1) | 33 parts by mass (10 mass % based on toner) |
| Magenta pigment dispersion (MN1) | 40 parts by mass (6 mass % based on toner) |

-continued

| Production of magenta toner (toner M1) | |
|---|---|
| Polyaluminum chloride 10 mass % aqueous solution (manufactured by Asada Kagaku K.K., PAC 100W) | 15 parts by mass |
| 1% nitric acid aqueous solution | 3 parts by mass |

The above-mentioned components are dispersed at 5000 rpm for 3 minutes using a homogenizer (manufactured by LKA, Ultratalax T50) in a round-shaped stainless steel flask, and then a lid equipped with a stirrer having magnetic seal, thermometer and pH meter is mounted on the flask. Thereafter, a mantle heater is set, and the flask is heated up to 48° C. at a rate of 1° C./min while stirring at revolution appropriately controlled to the minimum level for stirring the whole dispersion in the flask, the temperature is kept at 48° C. for 30 minutes, and the particle size of the aggregated particles is confirmed by a coulter counter (TA II, manufactured by Nikkaki K.K.). Thereafter, the temperature in the flask is raised at a rate of 0.1° C./15 min while confirming the aggregated particle size every 15 minutes, and when the volume-average particle size of the aggregated particles reaches 5.2 μm, temperature raising is stopped, and the temperature is kept. Regarding the particle size of the aggregated particles at this stage, the volume-average particle size is 5.2 μm and the number-average particle size distribution GSDP is 1.23. Directly after stopping of temperature raising, 50 parts by mass of the resin fine particle dispersion (L1) is added to the aggregated particle dispersion, and the mixture is kept for 30 minutes, and then a sodium hydroxide aqueous solution is added to the mixture until pH of the system reaches 6.5, and the mixture is heated up to 97° C. at a rate of 1° C./min. After raising temperature, a nitric acid aqueous solution is added to the system to control pH of the system to be 5.0, and the mixture is kept for 10 hours to cause thermal coalescence of the aggregated particles. Thereafter, the temperature of the system is cooled to 50° C., and an aqueous sodium hydroxide solution is added to the system to control pH thereof to be 12.0, and the mixture is kept for 10 minutes. Then, the content is removed out of the flask, and filtrated, and the obtained particles are washed sufficiently wish flowing water (ion exchanged water), and then further dispersed in ion exchanged water so that the solid content reaches 10 mass %, and a nitric acid is added to the resultant dispersion and the mixture is stirred for 10 minutes at a pH of 3.0, and then filtrated and the obtained particles are washed sufficiently with flowing water (ion exchanged water) again, and the resultant slurry is freeze-dried and thus a magenta toner (toner M1) is obtained. The toner M1 has a volume-average particle size $D_{50V}$ of 5.9 μm, a number-average particle size distribution index GSDP of 1.20, and a volume-average particle size distribution index GSDv of 1.19 and a water content of 0.28%. The surface of this toner is observed by a scanning electron microscope (SEM), and the section thereof is observed by a transmission type electron microscope (TEM). It is found that the resin, pigment and other additives are coalesced as intended, and holes and unevenness are not found, and dispersed state of the pigment is also excellent. The shape factor SF1 of this toner is measured by Luzex image analysis apparatus and is 119, indicating approximately spherical form, and distribution of shape is not specifically observed.

| Production of cyan toner (toner C1) | |
|---|---|
| Resin fine particle dispersion (L1) | 163 parts by mass |
| Releasing agent fine particle dispersion (W1) | 33 parts by mass (10 mass % based on toner) |
| Cyan pigment dispersion (C1) | 33 parts by mass (5 mass % based on toner) |
| Polyaluminum chloride 10 mass % aqueous solution (manufactured by Asada Kagaku K.K., PAC 100W) | 15 parts by mass |
| 1% nitric acid aqueous solution | 3 parts by mass |

A cyan toner (C1) is obtained by the same method as the production method of the magenta toner except that the above-described components are used. This toner C1 has a volume-average particle size $D_{50}$ V of 5.9 μm, a number-average particle size distribution index GSDP of 1.19, and a volume-average particle size distribution index GSDv of 1.18 and a water content of 0.25%. The surface of this toner is observed by a scanning electron microscope (SEM), and the section thereof is observed by a transmission type electron microscope (TEM). It is found that the resin, pigment and other additives are coalesced as intended, and holes and unevenness are not found. The shape factor SF1 of this toner is measured by Luzex image analysis apparatus and is 116, indicating approximately spherical form, and distribution of shape is not specifically observed.

| Production of yellow toner | |
|---|---|
| Resin fine particle dispersion (L1) | 160 parts by mass |
| Releasing agent fine particle dispersion (W1) | 33 parts by mass (10 mass % based on toner) |
| Yellow pigment dispersion (Y1) | 40 parts by mass (6 mass % based on toner) |
| Polyaluminum chloride 10 mass % aqueous solution (manufactured by Asada Kagaku K.K., PAC 100W) | 15 parts by mass |
| 1% nitric acid aqueous solution | 3 parts by mass |

A yellow toner (Y1) is obtained by the same method as the production method of the magenta toner except that the above-described components are used. This toner has a volume-average particle size $D_{50V}$ of 5.9 μm, a number-average particle size distribution index GSDp of 1.21, and a volume-average particle size distribution index GSDv of 1.20 and a water content of 0.26%. The surface of this toner is observed by a scanning electron microscope (SEM), and the section thereof is observed by a transmission type electron microscope (TEM). It is found that the resin, pigment and other additives are coalesced as intended, and holes and unevenness are not found. The shape factor SF1 of this toner is measured by Luzex image analysis apparatus and is 117, indicating approximately spherical form, and distribution of shape is not specifically observed.

Example 2

A magenta toner M2 is obtained in the same manner as in Example 1 except that heating temperature after controlling pH of the system to be 6.5 is changed to 96° C., and the heating time at 96° C. is changed to 5 hours in production of the magenta toner in Example 1. Similarly, a cyan toner C2 is obtained in the same manner as in Example 1 except that heating temperature after controlling pH of the system to be 6.5 is changed to 93° C., and the heating time is changed to 4 hours in production of the cyan toner in Example 1. Similarly, a yellow toner Y2 is obtained in the same manner as in Example 1 except that heating temperature after controlling pH of the system to be 6.5 is changed to 94° C., and the heating time is changed to 5 hours in production of the yellow toner in Example 1.

Comparative Example 1

A magenta toner M11 is obtained in the same manner as in Example 1 except that heating temperature after controlling pH of the system to be 6.5 is changed to 90° C., and the heating time at 90° C. is changed to 6 hours in production of the magenta toner in Example 1. Similarly, a cyan toner C11 is obtained in the same manner as in Example 1 except that heating temperature after controlling pH of the system to be 6.5 is changed to 90° C., and the heating time is changed to 6 hours in production of the cyan toner in Example 1. Similarly, a yellow toner Y11 is obtained in the same manner as in Example 1 except that heating temperature after controlling pH of the system to be 6.5 is changed to 90° C., and the heating time is changed to 6 hours in production of the yellow toner in Example 1.

Comparative Example 2

A magenta toner M12 is obtained in the same manner as in Example 1 except that the amount of the magenta pigment dispersion (MN2) is changed to 26.7 parts by mass and the amount of the magenta pigment dispersion (MK1) is changed to 26.7 parts by mass (the amount of the magenta pigment is 8% by mass based on the toner, the ratio of PR185 to PR122 is 50:50) in production of the magenta toner in Example 1.

Example 3

A magenta toner M3 is obtained in the same manner as in Example 1 except that the amount of the magenta pigment dispersion (MN1) is changed to 32 parts by mass and the amount of the magenta pigment dispersion (MK1) is changed to 8 parts by mass (the amount of the magenta pigment is 6% by mass based on the toner, the ratio of PR238 to PR122 is 80:20) in production of the magenta toner in Example 1.

Example 4

A magenta toner M4 is obtained in the same manner as in Example 1 except that the amount of the magenta pigment dispersion (MN1) is changed to 23.3 parts by mass and the amount of the magenta pigment dispersion (MK1) is changed to 23.3 parts by mass (the amount of the magenta pigment was 7% by mass based on the toner, the ratio of PR238 to PR122 is 50:50) in production of the magenta toner in Example 1.

Example 5

A magenta toner M5 is obtained in the same manner as in Example 1 except that the amount of the magenta pigment dispersion (MN1) is changed to 16 parts by mass and the amount of the magenta pigment dispersion (MK1) is changed to 37.3 parts by mass (the amount of the magenta pigment is 8% by mass based on the toner, the ratio of PR238 to PR122 is 30:70) in production of a magenta toner in Example 1.

Various physical properties of the magenta toners obtained in Examples 1 to 5 and Comparative Examples 1 to 2 are shown in Table 1.

TABLE 1

| Magenta toner | | Example 1 | Example 2 | Example 3 | Example 4 | Example 5 | Comparative example 1 | Comparative example 2 |
|---|---|---|---|---|---|---|---|---|
| Kind of pigment | Pigment 1 | PR238 | PR238 | PR238 | PR238 | PR238 | PR238 | PR185 |
| | Pigment 2 | — | — | PR122 | PR122 | PR122 | — | PR122 |
| | Pigment content ratio (Pigment 1/Pigment 2) | 100/0 | 100/0 | 80/20 | 50/50 | 30/70 | 100/0 | 50/50 |
| | Shape factor FS1 | 119 | 135 | 118 | 119 | 119 | 143 | 120 |
| | Volume-average particle diameter $D_{50\ v}$ ($\mu$m) | 5.9 | 5.9 | 5.9 | 5.8 | 5.9 | 6.0 | 5.7 |
| | Volume-average particle size distribution index GSDv | 1.19 | 1.19 | 1.20 | 1.20 | 1.20 | 1.19 | 1.21 |
| | Number-average particle size distribution index GSDp | 1.20 | 1.21 | 1.22 | 1.22 | 1.22 | 1.22 | 1.23 |

| [Production of carrier] | |
|---|---|
| Ferrite particles (average particle size: 35 $\mu$m) | 100 parts by mass |
| Toluene | 14 parts by mass |
| Perfluorooctyl ethyl methacrylate/methyl methacrylate copolymer (copolymerization ratio: 15/85) | 2 parts by mass |
| Carbon black (VXC72: manufactured by Cabot Corporation) | 0.2 parts by mass |

First, the components other than the ferrite particles are stirred for 10 minutes by a sand mill, and the dispersed coating solution is weighed, and then this coating solution and the ferrite particles are placed in a vacuum deaeration type kneader, and the pressure is reduced to −20 mH at 60° C. while stirring and the coating solution and the ferrite particles are mixed for 30 minutes. Thereafter, temperature is raised and pressure is reduced and the mixture is stirred for 30 minutes at 90° C./−720 mHg to dry the particles and then a carrier is obtained. This carrier has a volume intrinsic resistivity of $10^{11}$ Ωcm under an applied field of 1000 V/cm.

[Production of Toner with External Additives]

100 parts by mass of each of the toners obtained in the examples and comparative examples is blended with 1.2 parts by mass of hydrophobic titanium oxide (manufactured by Nippon Aerosil K.K., T805), 2.0 parts by mass of hydrophobic silica 1 (manufactured by Nippon Aerosil K.K., RY50), 2.0 parts by mass of hydrophobic silica 2 (obtained by treating silica having a particle size of 140 nm and produced by a sol gel method according to JP-A No. 2001-066820, with HMDS) and 1.0 part by mass of cerium oxide (manufactured by Mitsui Mining & Smelting Co., Ltd., E10) by a 5 liter henschel mixer at a peripheral speed of 30 m/s for 15 minutes, and then coarse particles are removed by a sound wave sieve having an opening of 45 $\mu$m, to obtain toners with external additives of Examples 1 to 5 and Comparative Example 1 to 2, respectively.

[Production of Developer]

100 parts by mass of the carrier is blended with 8 parts by mass of each of the toner with external additives for 20 minutes by a V form blender, and then aggregated particles are removed by a vibration sieve having an opening of 212 $\mu$m to obtain developers of Examples 1 to 5 and Comparative Example 1 to 2, respectively.

[Color Range Evaluation 1]

The resultant developers of Examples 1 to 5 and Comparative Examples 1 to 2 are set in a developing apparatus of DocuCentre Color 500 CP modified machine (modified machine in which fixation members is composed of a pair of rolls), and the development toner amount for each color on paper is controlled to be 3.5 g/cm$^2$, and primary colors of magenta (M), cyan (C) and yellow (Y) and secondary colors of red (R), blue (B) and green (G) obtained by overlapping primary colors at 1:1 are output. C2r paper (smoothness: 28) manufactured by Fuji Xerox Office Supply Co., Ltd. is used as paper. The toner of Example 1 is output also on J coat paper (smoothness: 666). The color range of the output image is measured by using a colorimeter. The results are shown in a graph of FIG. 1. In FIG. 1, Japan Colors 2$^{nd}$ version showing print standard color samples for comparison are described, together with the results of Examples 1 to 2 and Comparative Examples 1 to 2.

Japan Colors were selected as standard colors in Japan by Japanese domestic committee of International Standardization Organization print technology committee (ISO/TC130). For selection, process inks for one sheet planographic printing plate that are regarded as being the most standard were collected one by one from Japan's main eight ink makers, and the colors were developed under the same condition, the color values were measured, and the average value was calculated. Selected Japan Colors were submitted to International Standardization Organization in 1990, and now used as Japanese color standards. Standard color samples are provided from Japanese domestic committee of International Standardization Organization print technology committee (ISO/TC130) and easily available.

[Color Range Evaluation Result 1]

As is clear from the results in FIG. 1, when the toner of Example 1 is output on J coat paper, very wide color range is shown. Even when toners of Examples 1 and 2 are output on C2r paper, color ranges corresponding to Japan Colors are shown in the ranges of magenta, blue and red relating to magenta. Also in impression of images in addition to color range, incompatibility sense due to thickness of images felt in conventional electrophotography toners is reduced, and unity feeling with paper nearer to print is felt. On the other hand, in the toner having poor shape factor in Comparative Example 1, uneven transfer is observed in images at stages before fixation, and the color range is also narrow as compared with Japan Color. The toner in Comparative Example 2 has a shape factor which is approximately spherical, and image failure is not observed at the stage of transfer, however, due to different pigment kind, color range is narrower than Japan Color. Further, with the toner of Comparative Example 2, though color reproducibility near Japan Color is obtained, the color range of Japan Color is not strictly attained, while, with toners of Examples 1 and 2, wider color ranges can be obtained.

[Color Range Evaluation 2]

Figure 2:
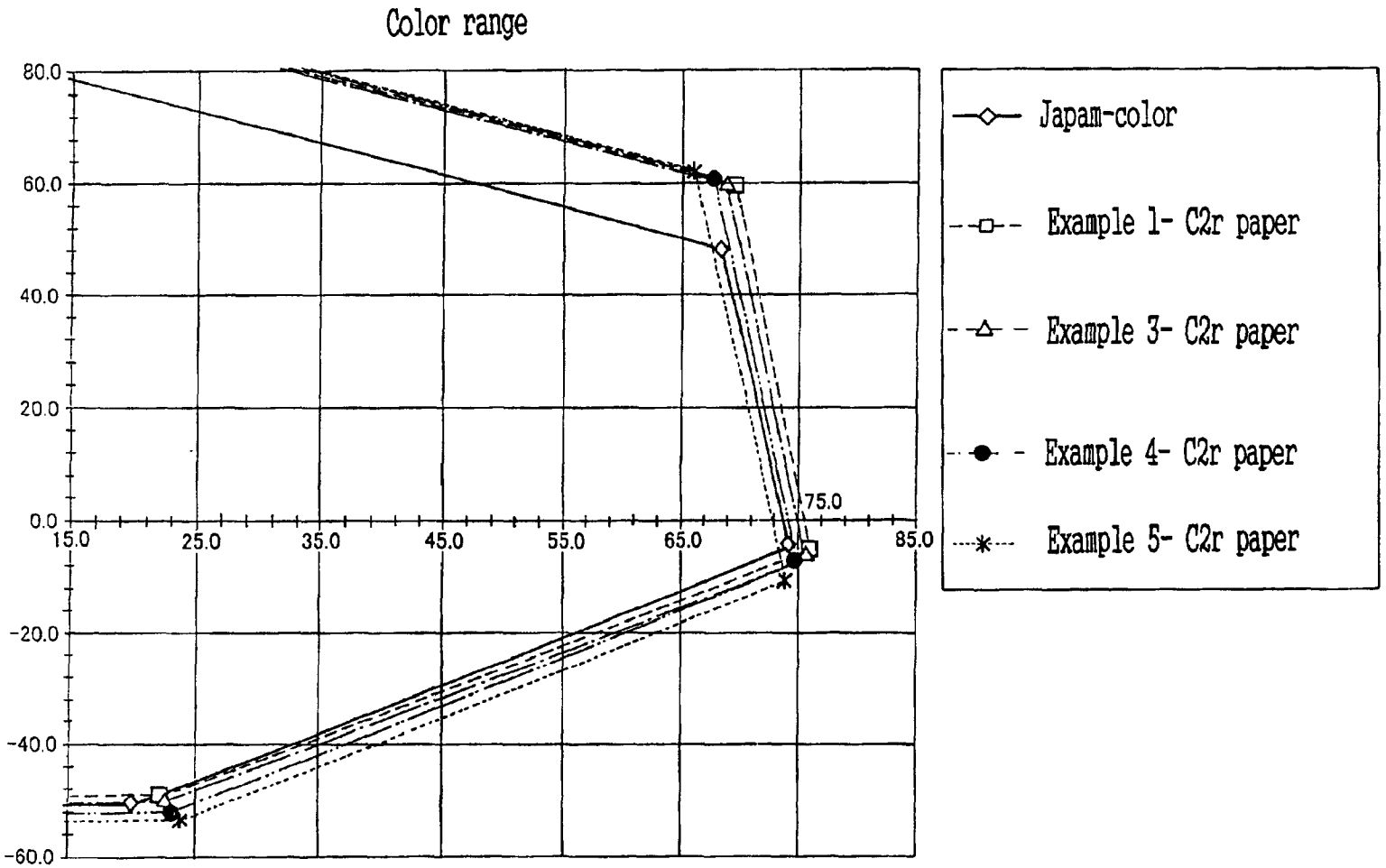
FIG. 2 is a view showing the results of color range evaluation 2 in examples.

The resultant developers of Examples 1 to 5 and Comparative Examples 1 to 2 are evaluated in the same manner as in color evaluation 1. The results are shown in a graph of FIG. 2. In FIG. 2, Japan Colors 2$^{nd}$ version showing print standard color samples for comparison and the results of Example 1 (in the case of C2r paper) are described, together with the results of Examples 3 to 5. In FIG. 2, only color ranges of yellow and blue regions are shown.

[Color Range Evaluation Result 2]

As is clear from the results in FIG. 2, the addition amount of the quinacridone pigment is increased in Examples 3 to 5. The larger the amount is, the broader the color range of blue is. On the other hand, with increase in the amount of the quinacridone pigment, the color range in yellow region shifts to yellow side. The reason for this is that yellow is strengthen because of decrease in coloring force of the magenta toner. Similarly, the color range tends to narrow in the magenta region. In order to correctly reproduce the color range of Japan Color, it is preferable to suppress the addition amount of the quinacridone pigment approximately to the level in Example 5.

[Color Range Evaluation 3]

Figure 3:
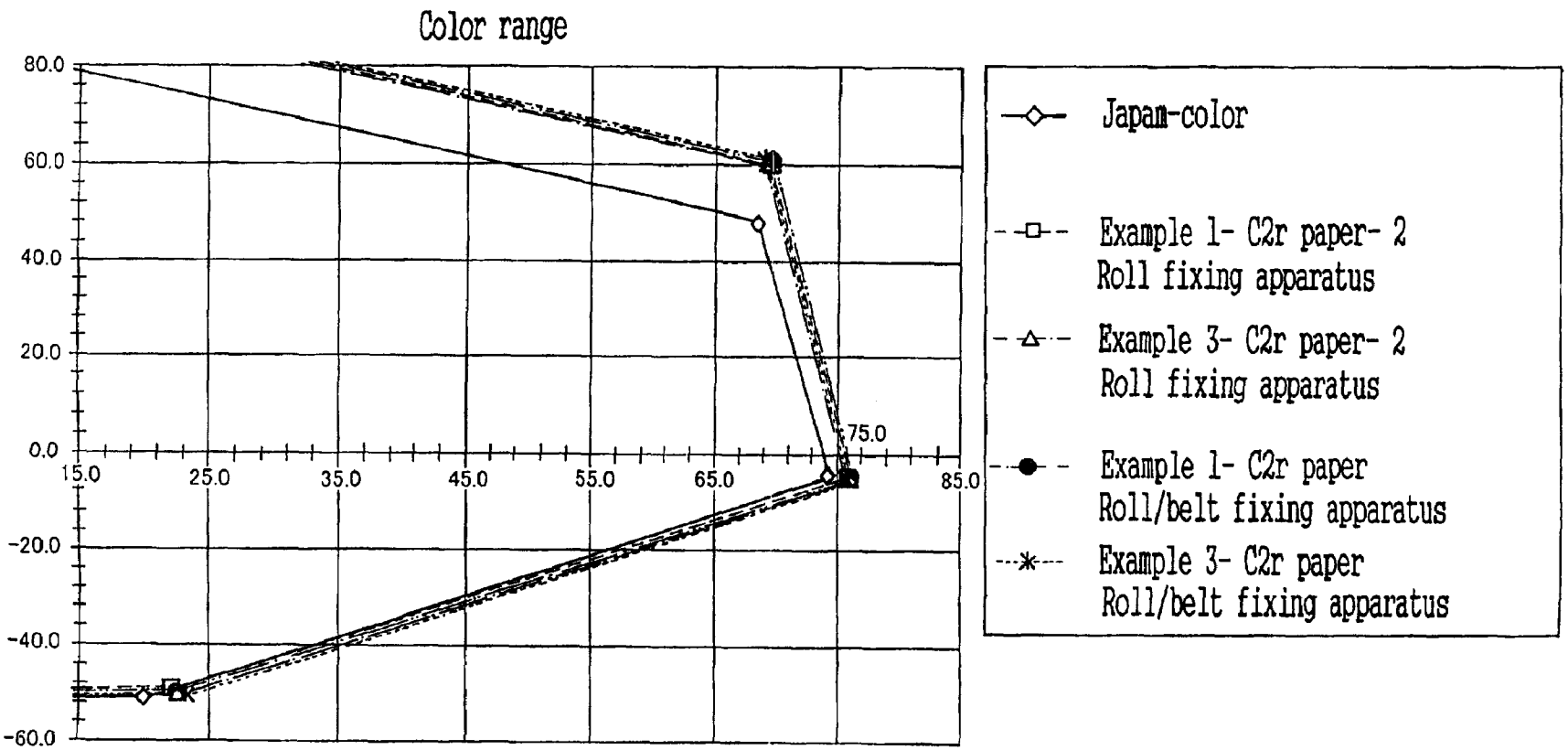
FIG. 3 is a view showing the results of color range evaluation 3 in examples.

The developers of Examples 1 and 3 are set on DocuCentre Color 500CP modified machine, andunfixed images are output. The resultant unfixed images are removed from Docucentre Color 500CP, and fixed at a process speed of 120 mm/sec and a fixation temperature of 180° C. using a fixation bench (fixation member is composed of heat roll and non-heating press belt) modified so that temperature and process speed can be changed. Evaluation is conducted in the same manner as in color range evaluation 1 except the above-mentioned changed condition. The results are shown in a graph of FIG. 3. In FIG. 3, Japan Colors 2$^{nd}$ version showing print standard color samples for comparison and the results of Examples 1 and 3 (in the case of use of roll/roll fixation apparatus) are described, together with the results of Examples 1 and 3 (in the case of use of roll/belt fixation apparatus). In FIG. 3, only color ranges of yellow and blue regions are shown.

[Color Range Evaluation Result 3]

As is clear from the results in FIG. 3, when a roll/belt type fixation apparatus is used, the color range is broaden particularly in blue region, though slight as compared with the absolute value of the color range. The reason for this is estimated that, by adopting roll/belt type constitution, heating time can be elongated, and consequently, fixation can be conducted when the viscosity of the toner is higher. Further, since there is no heat fed from paper due to use of a non-heating belt, melting of the toner on paper can be suppressed, and consequently, generation of a permeation phenomenon can be suppressed. Though improvement extent of the color range is slight, images showing excellent granular feeling are obtained since soaking of images is suppressed. Similarly, in impression of images in addition to color range, incompatibility sense due to thickness of images felt in conventional electrophotography toners is reduced, and unity feeling with paper nearer to print is felt.

[Charging Evaluation]

Each 1 part by mass of the toners with external additives in Examples 1 to 5 and 20 parts by mass of the carrier are placed in a glass sample bottle, and seasoned under low temperature and low humidity environment (temperature 10° C., humidity 20%) and under high temperature and high humidity environment (temperature 30° C., humidity 80%) each for 48 hours, then, stirred by a tumbler mixer for 2 minutes and 60 minutes, respectively, and each charge amount is measured by blow-off tribo. The results are shown in Table 2.

TABLE 2

| | Example 1 | Example 2 | Example 3 | Example 4 | Example 5 |
|---|---|---|---|---|---|
| Charge amount (−μC/g) at high temperature and high humidity (2 min.) (H2) | 33 | 32 | 32 | 33 | 31 |
| Charge amount (−μC/g) at low temperature and low humidity (2 min.) (L2) | 40 | 39 | 39 | 41 | 36 |
| Environmental ratio of H2/L2 | 0.83 | 0.82 | 0.82 | 0.80 | 0.86 |
| Charge amount (−μC/g) at high temperature and high humidity (60 min.) (H60) | 31 | 29 | 28 | 28 | 27 |
| Charge amount (−μC/g) at low temperature and low humidity (60 min.) (L60) | 37 | 34 | 34 | 34 | 33 |
| Environmental ratio of H60/L60 | 0.84 | 0.85 | 0.82 | 0.82 | 0.82 |

[Charging Evaluation Result]

As is clear from the results of Table 2, for each tone, charge amount and environmental ratio are also excellent, consequently, change in charge amount depending on stirring time is small, and chargeability is extremely excellent.

[Maintaining Property Evaluation]

Each 8 parts by mass of the toners with external additives of Examples 1 to 5 are used based on 100 parts by mass of the carrier to prepare developers, and the each of the resultant developers is set on a developing apparatus of Docucentre Color 500 CP modified machines, and overall image charts (including solid image, letter image, images of person and landscape) are output, and durability test is conducted on 10,000 pieces of paper, and image quality deterioration is evaluated.

[Maintaining Property Evaluation Result]

From the result of evaluation, even after output of 10,000 pieces of paper, image defects such as fogging and spattering, and deterioration in image qualities such as transferring property and graininess, are not observed, and excellent image qualities are maintained both in the initial period and after the test.

What is claimed is:

1. A magenta toner for electrophotography comprising a binder resin and a colorant, wherein the toner is obtained by a wet production method comprising the steps of: aggregating a dispersion of resin fine particles and colorant particles to form an aggregated particle dispersion; and coalescing the aggregated particles by heating the aggregated particle dispersion, wherein the toner contains at least a naphthol pigment having a structure represented by the following general formula (1) and a quinacridone pigment as the colorant, wherein the content ratio of the naphthol pigment to the quinacridone pigment is 80:20 to 30:70, General formula (1)

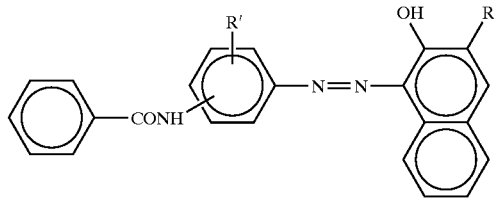

wherein R is selected from a group consisting of the following groups,

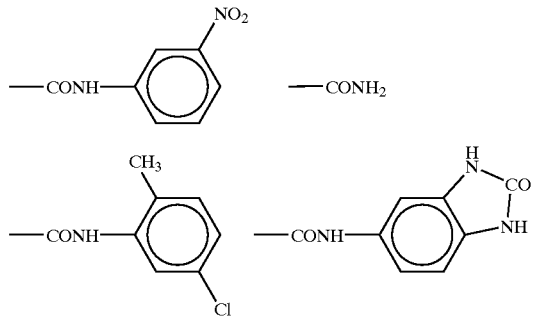

-continued

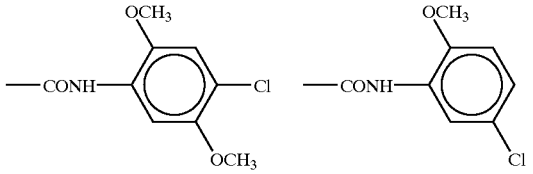

and R' represents a hydrogen atom, an alkyl group or a methoxy group;

and wherein the toner has a shape factor SF1 of 110 to 140 obtained by the equation below and a volume average particle size of 2 to 9 $\mu$m:

$$SF1=R^2/A\times\pi/4\times100$$

wherein R represents the maximum length of the toner and A represents the projected area of the toner.

2. The magenta toner for electrophotography according to claim 1, wherein the toner has a volume-average particle size distribution index GSDv of 1.25 or less.

3. The magenta toner for electrophotography according to claim 1, wherein the shape factor SF1 is 113 to 137.

4. The magenta toner for electrophotography according to claim 1, wherein the absolute value of charge amount of the toner is 10 to 50 $\mu$C/g.

5. The magenta toner for electrophotography according to claim 1, further including a releasing agent.

6. The magenta toner for electrophotography according to claim 5, wherein the releasing agent has a melting point of 70 to 120° C. and a main maximum heat absorption peak of 50 to 140° C.

7. The magenta toner for electrophotography according to claim 1, wherein the quinacridone pigment is represented by the following general formula (3):

General formula (3)

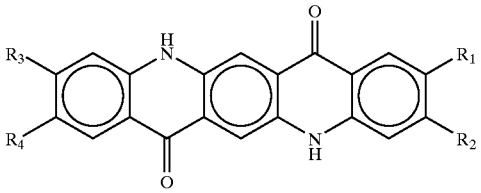

wherein $R_1$, $R_2$, $R_3$ and $R_4$ represent H, $CH_3$ or Cl, $R_1$ is not the same as $R_2$, and $R_3$ is not the same as $R_4$.

8. The magenta toner for electrophotography according to claim 1, wherein the colorant particles have an average diameter of about 0.05 $\mu$m to about 0.5 $\mu$m.

9. The magenta toner for electrophotography according to claim 1, wherein the resin fine particles have an average median size of about 50 nm to about 400 nm.

10. A developer comprising a magenta toner for electrophotography and a carrier, the toner comprising a binder resin and a colorant, wherein the toner is obtained by a wet production method comprising the steps of: aggregating a dispersion of resin fine particles and colorant particles to form an aggregated particle dispersion; and coalescing the aggregated particles by heating the aggregated particle dispersion, the magenta toner including at least a naphthol pigment having a structure represented by the following general formula (1) and a quinacridone pigment as the colorant, wherein the content ratio of the naphthol pigment to the quinacridone pigment is 80:20 to 30:70.

General formula (1)

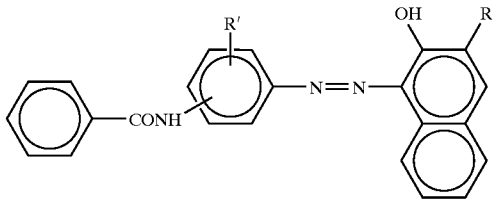

wherein R is selected from a group consisting of the following groups,

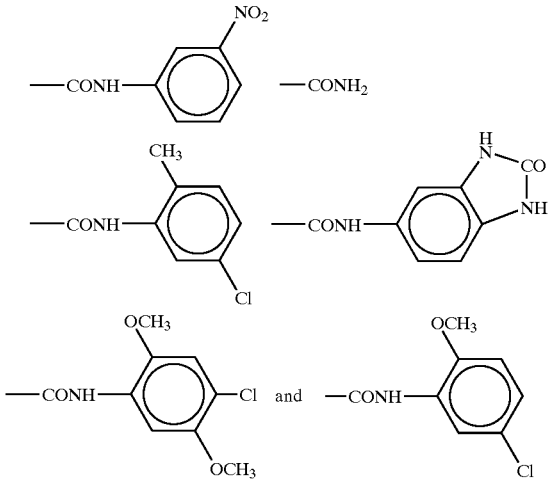

and R' represents a hydrogen atom, an alkyl group or a methoxy group;

and wherein the toner has a shape factor SF1 of 110 to 140 obtained by the equation below and a volume average particle size of 2 to 9 $\mu$m:

$$SF1=R^2/A\times\pi/4\times100$$

wherein R represents the maximum length of the toner and A represents the projected area of the toner.

11. The developer according to claim 10, wherein the carrier has a resin coat layer.

12. A method of producing the magenta toner for electrophotography claim 1, comprising the steps of:

forming aggregated particles containing the resin fine particles and the colorant particles in a dispersion containing the resin fine particles and the colorant particles to prepare an aggregated particle dispersion; and coalescing the aggregated particles.

13. The method of claim 12, wherein the resin fine particles have a median size of 1 $\mu$m or less.

14. A method of forming a full color image comprising the steps of:

forming an electrostatic latent image on a photoreceptor;

developing the electrostatic latent image using a developer containing a toner, to form a toner image;

transferring the toner image onto a recording medium; and thermally fixing the toner image on the recording medium, wherein the toner is a magenta toner for electrophotography according to claim 1.

15. The method of claim 14, wherein the thermal fixation is conducted using a fixing apparatus equipped with a fixing member composed of a pair of rotating members contacting upper and lower surfaces of the recording medium, with at least one of the pair of rotating members being a belt member.

16. The method of claim 14, further including a cleaning step of removing toner on the photoreceptor after transferring the toner image onto the recording medium.

17. The method of claim 16, wherein the removal includes returning the recovered toner to a developer.

* * * * *

UNITED STATES PATENT AND TRADEMARK OFFICE

CERTIFICATE OF CORRECTION

PATENT NO. : 6,933,092 B2
APPLICATION NO. : 10/219657
DATED : August 23, 2005
INVENTOR(S) : Satoshi Yoshida et al.

It is certified that error appears in the above-identified patent and that said Letters Patent is hereby corrected as shown below:

Title page,
Item [75], Inventors, after "Takahisa FUJII, Minamiashigara (JP)" insert -- ; Tomohito NAKAJIMA, Minamiashigara (JP) --.

Signed and Sealed this

Fourth Day of July, 2006

JON W. DUDAS
*Director of the United States Patent and Trademark Office*